US012805604B2

(12) United States Patent
Chen

(10) Patent No.: US 12,805,604 B2
(45) Date of Patent: Nov. 24, 2026

(54) FASTENING DEVICE

(71) Applicant: Chin-Chu Chen, Taichung (TW)

(72) Inventor: Chin-Chu Chen, Taichung (TW)

( * ) Notice: Subject to any disclaimer, the term of this patent is extended or adjusted under 35 U.S.C. 154(b) by 158 days.

(21) Appl. No.: 18/739,296

(22) Filed: Jun. 10, 2024

(65) Prior Publication Data

US 2024/0423327 A1 Dec. 26, 2024

Related U.S. Application Data

(60) Provisional application No. 63/521,943, filed on Jun. 20, 2023.

(30) Foreign Application Priority Data

Apr. 11, 2024 (TW) ..... 113113590

(51) Int. Cl.
*A43C 11/00* (2006.01)
*A43C 11/16* (2006.01)

(52) U.S. Cl.
CPC ..... *A43C 11/008* (2013.01); *A43C 11/165* (2013.01)

(58) Field of Classification Search
CPC ..... A43C 11/00; A43C 1/003; A43C 1/00; A43C 11/08; A43C 11/06; A43C 11/008; A43C 11/16; A43C 11/165; A44C 1/06; A44C 11/20; Y10T 24/3703; Y10T 24/37; F16G 11/12; B65H 75/30
USPC ..... 36/58.5
See application file for complete search history.

(56) References Cited

U.S. PATENT DOCUMENTS

2015/0007422 A1* 1/2015 Cavanagh ..... A43C 11/165 29/434
2015/0313319 A1* 11/2015 Ha ..... A43C 11/165 24/712
2020/0087104 A1* 3/2020 Wang ..... B65H 75/4415
2021/0127794 A1* 5/2021 Chen ..... A43C 11/06
2021/0251343 A1* 8/2021 Martin ..... A43C 11/165

* cited by examiner

*Primary Examiner* — Jack W Lavinder
(74) *Attorney, Agent, or Firm* — CKC & Partners Co., LLC

(57) ABSTRACT

A fastening device includes a case unit including an inner space, a spool received within the inner space and configured for a lace to be wound thereabout, an engaging unit disposed above the spool along an axis, a torque unit disposed above the engaging unit along the axis and including at least one torque portion, and a knob covering the case unit. As a rotation of the knob in a tensioning direction causes the torque unit to drive the engaging unit for allowing the knob to drive the spool, the spool is rotated in the tensioning direction to tension the lace, and as a force borne by the at least one torque portion exceeds a threshold, the spool is not rotated in the tensioning direction.

4 Claims, 24 Drawing Sheets

FASTENING DEVICE

RELATED APPLICATIONS

This application claims priority to U.S. Provisional Application Ser. No. 63/521,943, filed Jun. 20, 2023, and Taiwan Application Serial Number 113113590, filed Apr. 11, 2024, which are herein incorporated by reference in its entirety.

BACKGROUND

Technical Field

The present disclosure relates to a fastening device. More particularly, the present disclosure relates to a fastening device for securing an article through loosening or tightening a lace.

Description of Related Art

In daily life, cords, such as a lace or a thread, are usually used to tighten articles. The most common tightening method is to use the cord to reciprocatably pass through holes on the article, e.g., eyelets of a shoe, and then tie a knot to secure the article. But in this kind of tightening method, the knot is loosened easily owing to an external force. Not only does the knot need to be tied again, but also lots of inconveniences come owing to the insecurity of the articles.

In order to solve such problems, some practitioners developed a simple fastening mechanism including a case, an engaging unit and a spring. The case includes holes configured for the lace to pass therethrough. Through the reaction force between the spring and the engaging unit, the lace can be clamped between the engaging unit and the case so as to be fastened. The length of the lace can be changed by pressing the spring to change the position of the engaging unit. However, in such fastening mechanism, the restoring force of the spring is served as the securing force; thus, the lace is easily to be released owing to vibrations or an external force. In addition, the fastening mechanism has no space for receiving the lace, and the exposure of the lace may bring danger.

Therefore, some practitioners developed another kind of buckle which can be rotated to tighten the lace, and the lace can be received inside the buckle. Through the interference between components inside the buckle, the length of the lace as well as the tightness can be adjusted. However, in a status that the lace is under tensioned, if the buckle keeps operating to increase the tension, the tension borne by the lace may exceed the capacity thereof, and the lace may be broken or the article may be damaged.

Based on the above-mentioned problems, how to solve the problems becomes a target that those in the field pursue.

SUMMARY

According to one aspect of the present disclosure, a fastening device includes a case unit including an inner space, a spool received within the inner space and configured for a lace to be wound thereabout, an engaging unit disposed above the spool along an axis, a torque unit disposed above the engaging unit along the axis and including at least one torque portion, and a knob covering the case unit. As a rotation of the knob in a tensioning direction causes the torque unit to drive the engaging unit for allowing the knob to drive the spool, the spool is rotated in the tensioning direction to tension the lace, and as a force borne by the at least one torque portion exceeds a threshold, the spool is not rotated in the tensioning direction.

According to another aspect of the present disclosure, a fastening device includes a case unit including an inner space and a plurality of engaging teeth, a spool received within the inner space and configured for a lace to be wound thereabout, a knob covering the case unit, at least one pawl arm received in the inner space and corresponding to at least one of the engaging teeth, and at least one torque portion received in the inner space and being rotatably connected to one of the knob and the at least one pawl arm. As a rotation of the knob in a tensioning direction causes the at least one pawl arm to rotate, the spool is rotated in the tensioning direction to tension the lace, and as the lace is over tensioned, the at least one torque portion prohibits the spool from rotating in the tensioning direction.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1:
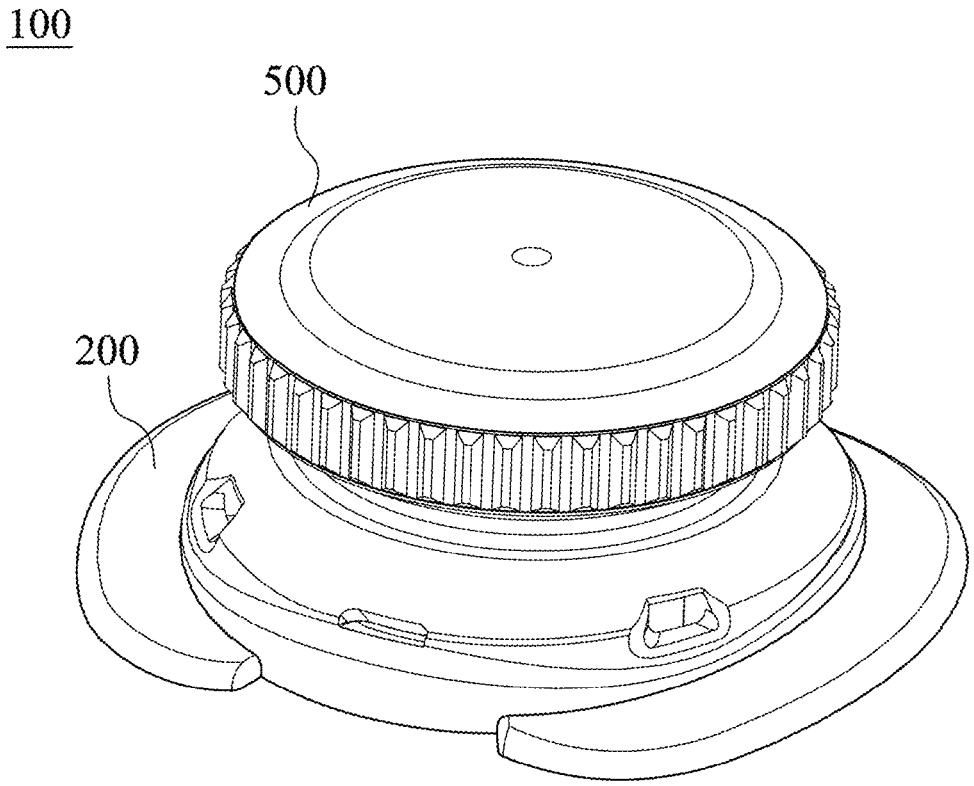
FIG. 1 shows a three-dimensional schematic view of a fastening device according to a first embodiment of the present disclosure.

The embodiments of the present disclosure will be illustrated with drawings hereinafter. In order to clearly describe the content, many practical details will be mentioned with the description hereinafter. However, it will be understood by the reader that the practical details will not limit the present disclosure. In other words, in some embodiment of the present disclosure, the practical details are not necessary. Additionally, in order to simplify the drawings, some conventional structures and elements will be illustrated in the drawings in a simple way; the repeated elements may be labeled by the same or similar reference numerals.

In addition, the terms first, second, third, etc. are used herein to describe various elements or components, these elements or components should not be limited by these terms. Consequently, a first element or component discussed below could be termed a second element or component. Moreover, the combinations of the elements, the components, the mechanisms and the modules are not well-known, ordinary or conventional combinations, and whether the combinations can be easily completed by the one skilled in the art cannot be judged based on whether the elements, the components, the mechanisms or the module themselves are well-known, ordinary or conventional.

Figure 2:
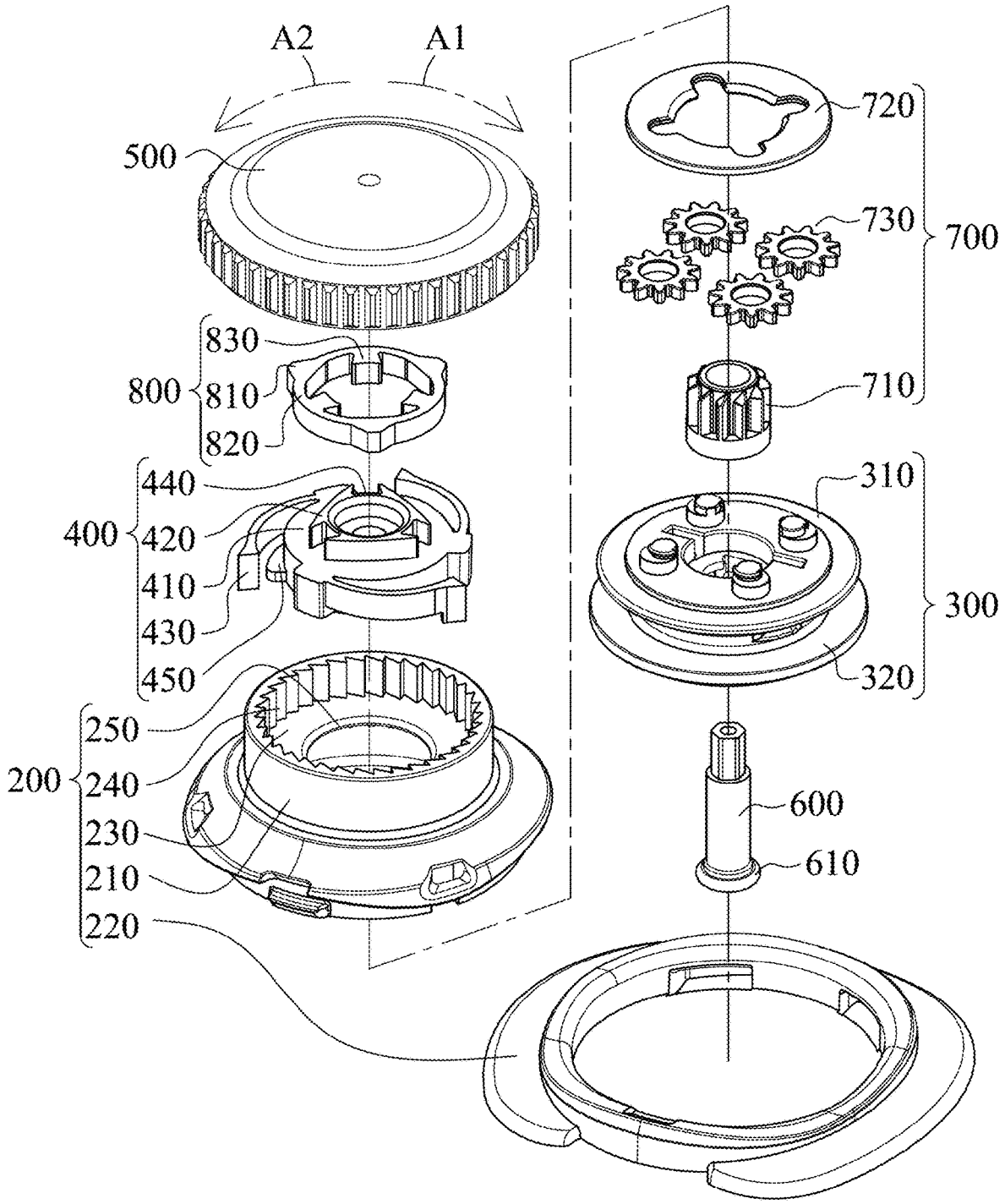
FIG. 2 shows one exploded view of the fastening device of the first embodiment of FIG. 1.
Figure 3:
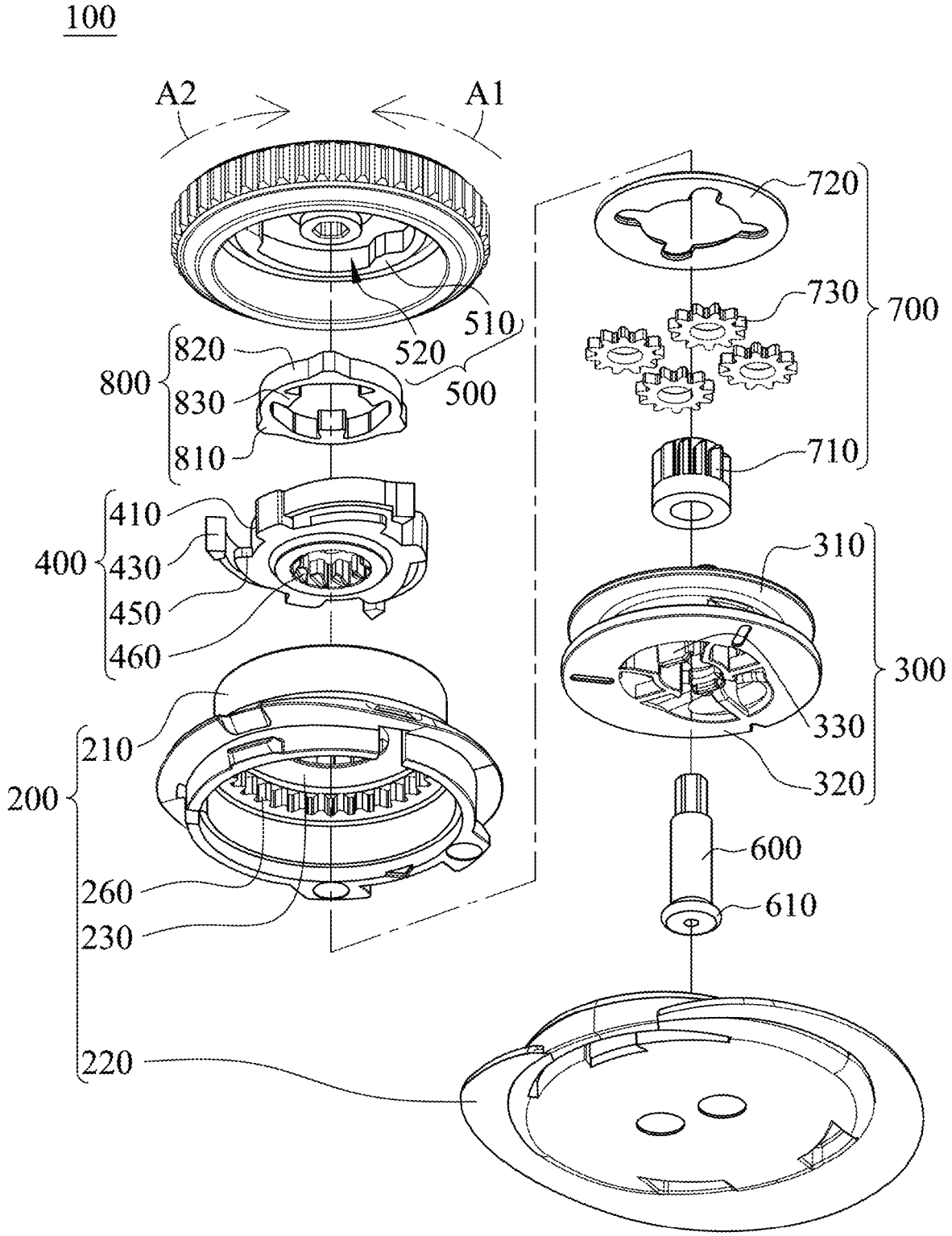
FIG. 3 shows another exploded view of the fastening device of the first embodiment of FIG. 1.

FIG. 1 shows a three-dimensional schematic view of a fastening device 100 according to a first embodiment of the present disclosure. FIG. 2 shows one exploded view of the fastening device 100 of the first embodiment of FIG. 1. FIG. 3 shows another exploded view of the fastening device 100 of the first embodiment of FIG. 1. The fastening device 100 includes a case unit 200, a spool 300, an engaging unit 400, a knob 500 and a torque unit 800.

The case unit 200 includes an inner space. The spool 300 is received within the inner space and is configured for a lace to be wound thereabout. The engaging unit 400 is located above the spool 300 along an axis 11 (shown in FIG. 4). The knob 500 is located above the engaging unit 400 along the axis 11. The torque unit 800 is rotatably connected to one of the knob 500 and the engaging unit 400, and the torque unit 800 selectively transmits a rotating force to the spool 300. As the knob 500 is rotated in a tensioning direction A1, the knob 500 drives the engaging unit 400 to rotate the spool 300 in the tensioning direction A1 for tensioning the lace. As the lace is over tensioned, the spool 300 is not rotated in the tensioning direction A1.

Therefore, as the lace is over tensioned, a user cannot rotate the spool 300 by the knob 500, and over tightening of the lace can be prevented. Details of the fastening device 100 may be described hereinafter.

The case unit 200 of the fastening device 100 may include a housing 210, a base 220, a partition 230, a plurality of engaging teeth 240, a central hole 250 and a plurality of inner teeth 260. The housing 210 defines the inner space and includes an upper opening and a lower opening, and the upper opening and the lower opening are communicated with the inner space. The base 220 is detachably connected to the housing 210 to close the lower opening by engagement, but the present disclosure is not limited thereto.

The partition 230 may protrude inward from the housing 210 to separate the inner space into an upper chamber and a lower chamber. The engaging teeth 240 are located at the housing 210 and are in the upper chamber, and the inner teeth 260 are located at the housing 210 and are in the lower chamber. The central hole 250 may penetrate the partition 230 to allow the upper chamber to be communicated with the lower chamber. The spool 300 may be received in the lower chamber.

The spool 300 may include a spool shaft body, an upper ring portion 310, a lower ring portion 320, a plurality of pivoting shafts, a spool hole and a flexible clamping portion 330. The upper ring portion 310 extends radially and outward from an upper end of the spool shaft body, the lower ring portion 320 extends radially and outward from a lower end of the spool shaft body, and a track is formed between the upper ring portion 310 and the lower ring portion 320 for the lace to be wound thereabout. The pivoting shafts are disposed at an upper surface of the spool shaft body. The spool hole penetrates the spool shaft body to form a spool inner surface. The flexible clamping portion 330 may include two clamping arms extend downward from the spool inner surface to form a clamping space for coupling a connecting unit of the fastening device 100, and the details thereof may be described hereinafter.

The engaging unit 400 may include an engaging disc 410, three pawl arms 430, three stopping portions 450 and a plurality of driving teeth 460. The engaging disc 410 is a hollow circle and includes a central through hole. Each of the pawl arms 430 extends outward from the engaging disc 410 and has a cantilever structure which may be deflected inward as being forced. Each of the stopping portions 450 extends outward from the engaging disc 410 and corresponds to a distal end of each of the pawl arms 430. As each of the pawl arms 430 is forced to be deflected inward, each of the stopping portions 450 may stop each of the pawl arms 430, thereby increasing the capability of prohibiting the spool 300 from rotating reversely. The driving teeth 460 may be disposed at a lower end of the engaging disc 410 to come near the spool 300.

The fastening device 100 may further include a transmission set 700 coupling to the driving teeth 460 of the engaging unit 400 and the spool 300. Precisely, the transmission set 700 may include a sun gear 710, a plurality of planet gears 730 and a plate 720. The sun gear 710 is driven by the driving teeth 460 of the engaging unit 400. Each of the planet gears 730 is pivotally disposed at each of the pivoting shafts of the spool 300 to engage with the sun gear 710 and the inner teeth 260 of the case unit 200. The plate 720 is placed above the planet gears 730 to cover the planet gears 730.

As shown in FIG. 2, the engaging unit 400 may further include a boss 420 and at least one engaging portion 440 along the axis 11, the boss 420 is integrally connected to the engaging disc 410, and the at least one engaging portion 440 is disposed at the boss 420. In the first embodiment, a number of the at least one engaging portion 440 is three, and each of the engaging portion 440 has a radial groove structure, but the present disclosure is not limited thereto.

The torque unit 800 may include a torque disc 820, at least one coupling portion 830 and at least one torque portion 810. A number of the at least one coupling portion 830 is three. The three coupling portions 830 are disposed with intervals at an inner edge of the torque disc 820, each of the coupling portions 830 may be engaged with each of the engaging portions 440, and each of the coupling portions 830 may have a bump structure extending radially and inward. The coupling portions 830 and the at least one torque portion 810 may be staggered along a radial direction. Specially, a number of the at least one torque portion 810 is also three and the three torque portions 810 are disposed with intervals at an outer edge of the torque disc 820. Moreover, one of the torque portions 810 is located between two of the coupling portions 830, and each of the torque portions 810 may have a triangular bump structure and include a forced inclined surface 811 (labeled in FIG. 6) for increasing the structural stability.

As assembling, the torque unit 800 may sleeve on the boss 420 of the engaging unit 400, each of the coupling portions 830 having the bump structure may coordinate with each of the engaging portions 440 having the groove structure, thereby rotatably connecting the torque unit 800 to the engaging unit 400, but the combination method is not limited thereto. In addition, after the torque unit 800 and the engaging unit 400 are assembled, a deforming space S1 (labeled in FIG. 6) is formed between at least one portion of the torque unit 800 and the boss 420. Therefore, as a force borne by the torque unit 800, especially borne by each of the torque portions 810, exceeds a threshold, the at least one portion of the torque unit 800 is deformed radially. In other words, with that the boss 420 is a triangle, that the torque disc 820 is a hollow circle, and that the engaging portions 440 are respectively located at three corners of the triangle to correspond to the coupling portions 830, three deforming spaces S1 may be respectively formed between three side edges of the triangle of the boss 420 and the inner edge of the hollow circle. Portions of the hollow circle corresponding to the side edges of the triangle of the boss 420 may be the portions that may be deformed radially and inward. Hence, with the configuration that each of the torque portions 810 are respectively located at each of the portions, especially the center position of each of the side edges, each of the torque portions 810 may be deformed as forced.

The knob 500 is cap-shaped. The knob 500 may be selectively coupled to the torque unit 800 and may include at least one pushing portion 510 corresponding to the at least one torque portion 810. A number of the at least one pushing portion 510 is three. The knob 500 may further include a top recess 520 for receiving the torque unit 800. The three pushing portions 510 are disposed at the side wall of the top recess 520 with intervals, and each of the pushing portions 510 may correspond to each of the torque portions 810. Each of the pushing portions 510 may include a pushing inclined surface 511 (labeled in FIG. 6) to correspond to the forced inclined surface 811 of each of the torque portions 810, and each of the pushing portions 510 pushes each of the torque portions 810 to rotate the engaging unit 400 in the tensioning direction A1.

Figure 4:
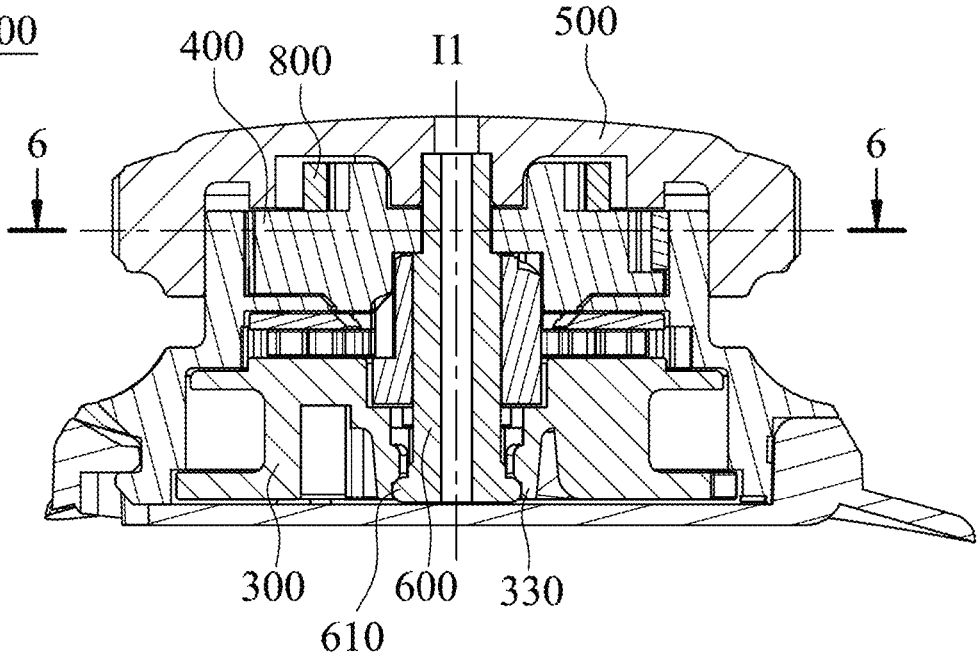
FIG. 4 shows one cross-sectional side view of the fastening device of the first embodiment of FIG. 1.
Figure 5:
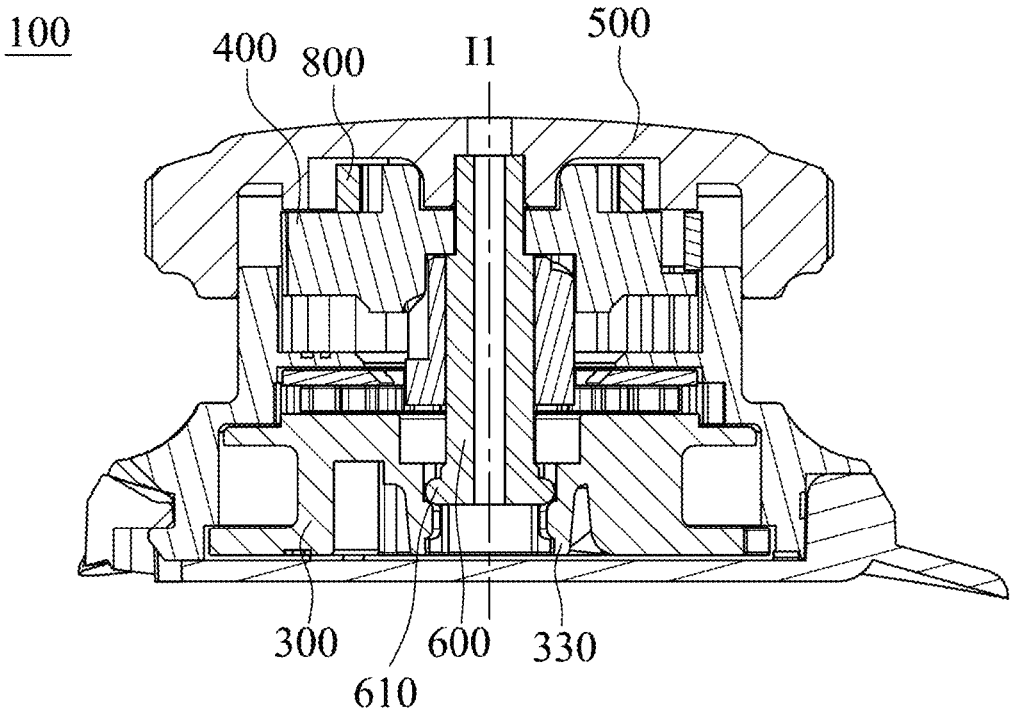
FIG. 5 shows another cross-sectional side view of the fastening device of the first embodiment of FIG. 1.
Figure 6:
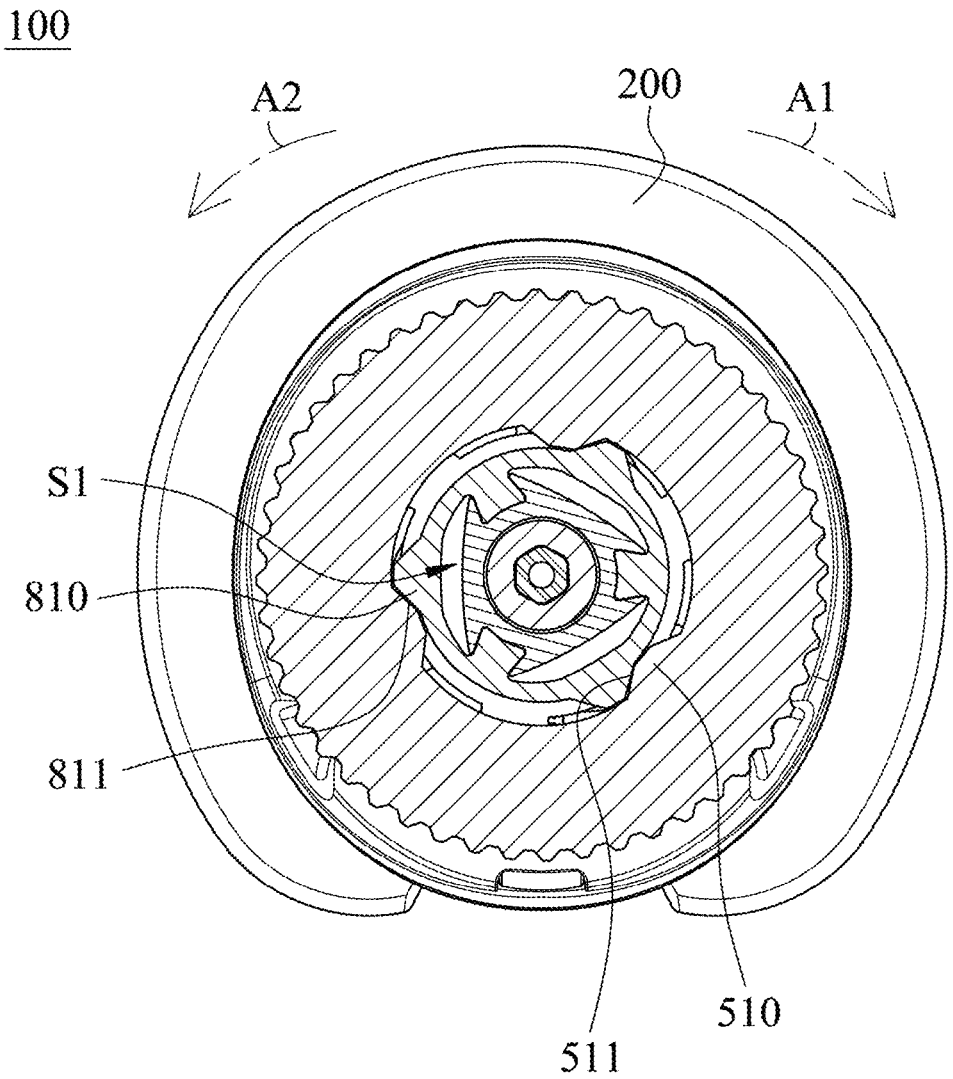
FIG. 6 shows a cross-sectional top view of the fastening device of the first embodiment of FIG. 4 taken along line 6-6.

FIG. 4 shows one cross-sectional side view of the fastening device 100 of the first embodiment of FIG. 1. FIG. 5 shows another cross-sectional side view of the fastening device 100 of the first embodiment of FIG. 1. FIG. 6 shows a cross-sectional top view of the fastening device 100 of the first embodiment of FIG. 4 taken along line 6-6. The fastening device 100 may further include the connecting unit. One end of the connecting unit is connected to the knob 500, and another end of the connecting unit is connected to the spool 300. The connecting unit may include a positioning post 600 and a screwing member. The positioning post 600 includes a positioning protrusion 610. The positioning post 600 is inserted upward into the spool 300 and the sun gear 710 and then enters a central post of the knob 500. The screwing member is inserted downward into the central post to fasten with the positioning post 600. The positioning post 600 and the knob 500 are connected in the axis 11.

As shown in FIGS. 4 and 6, the knob 500 is not pulled up, and the engaging unit 400 is positioned at a first position. The pushing inclined surface 511 of each of the pushing portions 510 corresponds the forced inclined surface 811 of each of the torque portions 810 of the torque unit 800, the driving teeth 460 of the engaging unit 400 is engaged with the sun gear 710, and each of the pawl arms 430 is engaged with the engaging teeth 240. As the user holds and rotates the knob 500 in the tensioning direction A1, each of the pushing portions 510 pushes each of the torque portions 810 to transmit the rotating force of the knob 500 to the engaging unit 400, the distal end of each of the pawl arms 430 is continuously disengaged from the engaging teeth 240, and the engaging unit 400 may drive the spool 300 to rotate in the tensioning direction A1 for tensioning the lace via the transmission set 700.

As the lace is tensioned, a force will exert on the spool 300 and try to rotate the spool 300 in a releasing direction A2, and each of the torque portions 810 will try to push each of the pushing portions 510 toward the releasing direction A2 so as to prevent from moving by each of the pushing portions 510 of the knob 500. Consequently, as the force borne by each of the torque portions 810 exceeds the threshold, the forced inclined surface 811 thereof slides relative to the pushing inclined surface 511 of each of the pushing portions 510, and each of the forced inclined surfaces 811 deforms radially and inward to allow each of the pushing portions 510 to cross over each of the torque portions 810, the knob 500 cannot drive the torque unit 800, and the spool 300 cannot be driven in the tensioning direction A1 for tensioning the lace. As the user stops exerting the force, the distal end of each of the pawl arms 430 is engaged with the engaging teeth 240 to prohibit the spool 300 from rotating in the releasing direction A2, and the lace cannot be released.

As shown in FIG. 5, the knob 500 is pulled upward to release the lace. As the knob 500 is pulled upward, the knob 500 and the positioning post 600 are moved along the axial axis 11. The positioning protrusion 610 of the positioning post 600 may be moved from a lower side of projections of the flexible clamping portion 330 to an upper side of the projections of the flexible clamping portion 330. The positioning post 600 moves the engaging unit 400 upward along the axis 11 to switch from the first position to a second position. At this time, each of the pawl arms 430 of the engaging unit 400 is disengaged from the engaging teeth 240, the engaging unit 400 does not prohibit the spool 300 from rotating in the releasing direction A2, and the lace is released.

Figure 7:
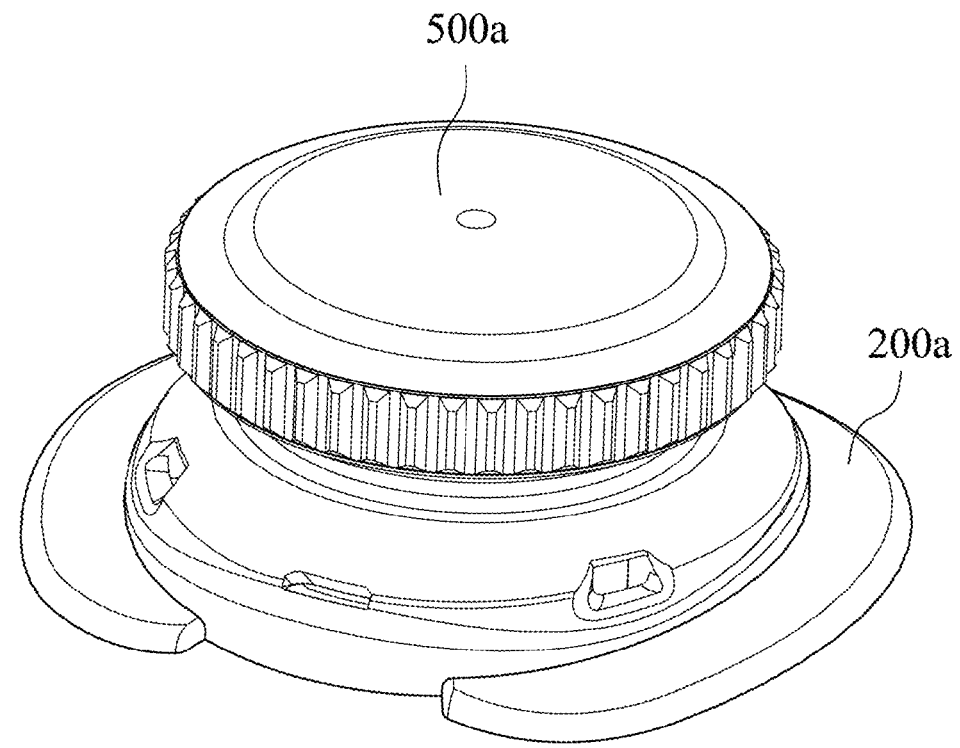
FIG. 7 shows a three-dimensional schematic view of a fastening device according to a second embodiment of the present disclosure.
Figure 8:
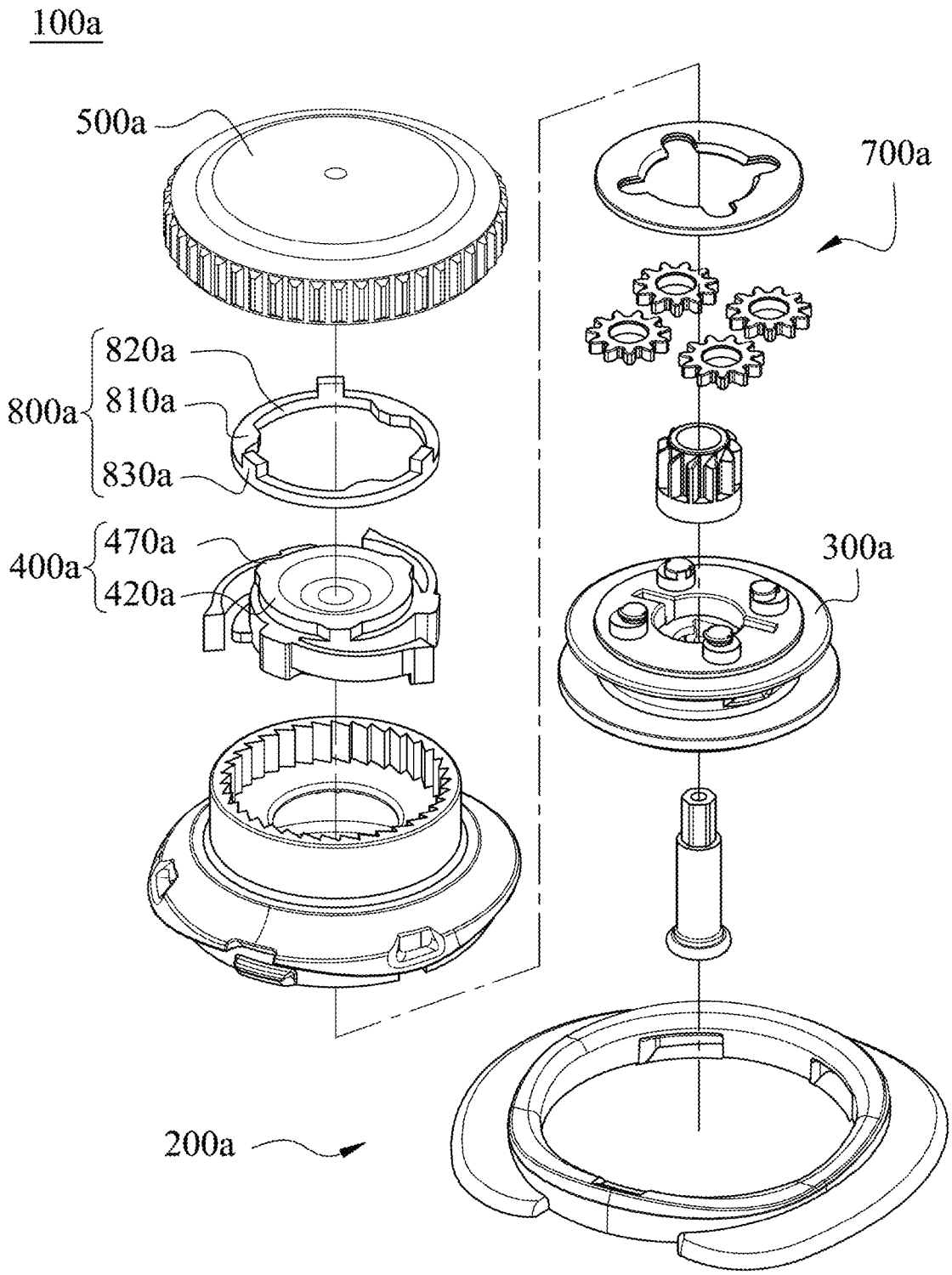
FIG. 8 shows one exploded view of the fastening device of the second embodiment of FIG. 7.
Figure 9:
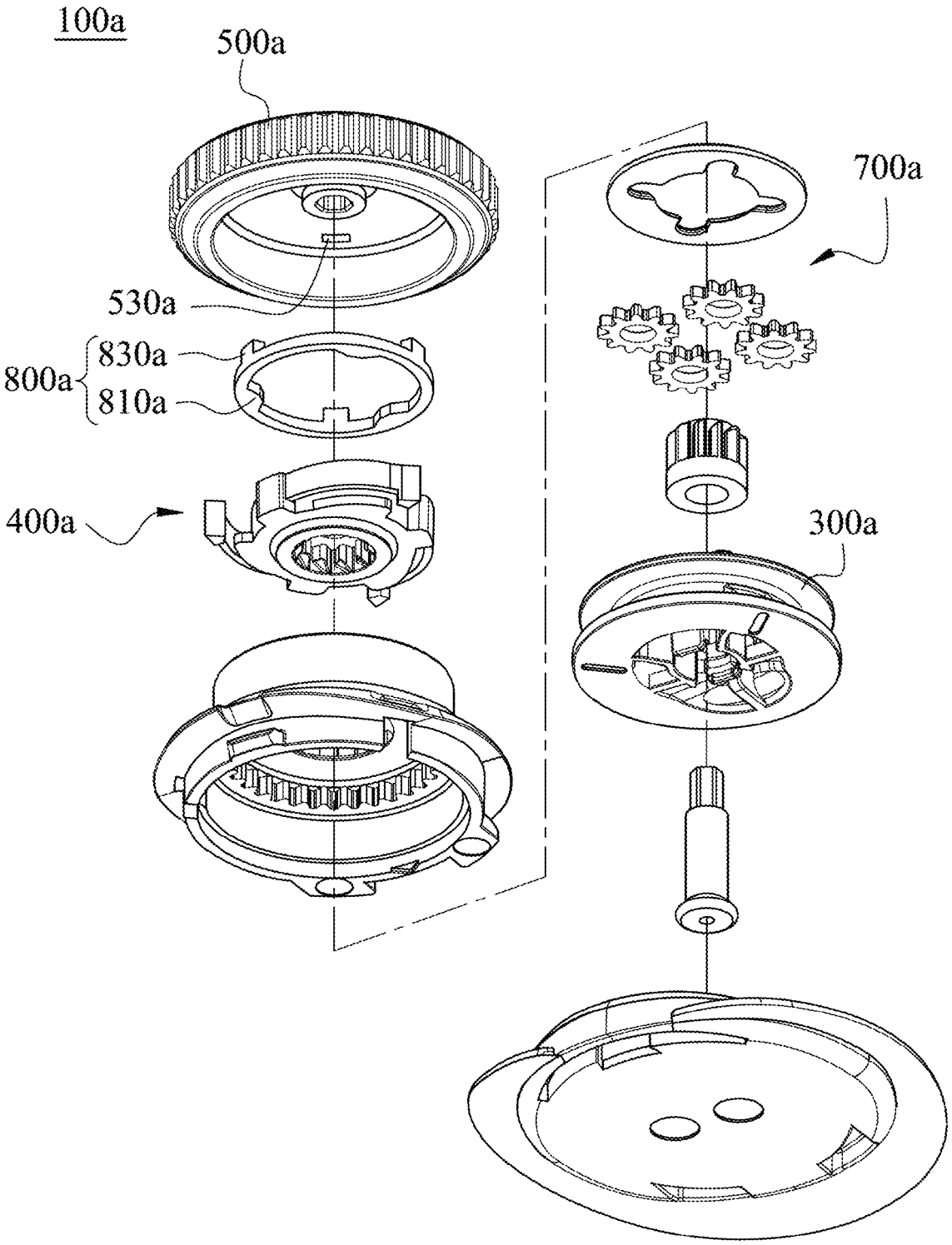
FIG. 9 shows another exploded view of the fastening device of the second embodiment of FIG. 7.

FIG. 7 shows a three-dimensional schematic view of a fastening device 100*a* according to a second embodiment of the present disclosure. FIG. 8 shows one exploded view of the fastening device 100*a* of the second embodiment of FIG. 7. FIG. 9 shows another exploded view of the fastening device 100*a* of the second embodiment of FIG. 7. The structure of the fastening device 100*a* of the second embodiment is similar to the structure of the fastening device 100 of the first embodiment and includes a knob 500*a*, a torque unit 800*a*, an engaging unit 400*a*, a transmission set 700*a*, a spool 300*a* and a case unit 200*a*. Only the differences thereof are illustrated hereinafter, and the identical or similar contents will not be repeated.

The torque unit 800*a* may include a torque disc 820*a*, three torque portions 810*a* and three coupling portions 830*a*. The three coupling portions 830*a* are disposed at an upper edge of the torque disc 820*a* and are coupled to the knob 500*a*, thereby rotatably connecting the torque unit 800*a* and the knob 500*a*. The three torque portions 810*a* may be disposed at an inner edge of the torque disc 820*a*. The engaging unit 400*a* may further include three forced portions 470*a* respectively corresponding to the three torque portions 810*a*. As a force borne by each of the torque portions 810*a* exceeds a threshold, each of the torque portions 810*a* is deformed to allow each of the torque portions 810*a* to move from one side of each of the forced portions 470*a* to another side of each of the forced portions 470*a*. It is noted that, a number of the forced portions 470*a* corresponds to a number of the torque portions 810*a*. Therefore, in other embodiments, as a number of the torque portion is at least one, a number of the forced portion is at least one.

Precisely, the knob 500*a* may include three engaging holes 530*a* disposed at an inner top of the knob 500*a* with intervals. Each of the engaging holes 530*a* is for each of the coupling portions 830*a* to insert therein, thereby assembling and rotatably connecting the torque unit 800*a* and the knob 500*a*.

A boss 420*a* of the engaging unit 400*a* may be a hollow circle, and each of the forced portions 470*a* may extend from an outer edge of the boss 420*a* radially and outward. As the engaging unit 400*a* and the torque unit 800*a* are assembled, each of the forced portions 470*a* may contact each of the torque portions 810*a*.

Figure 10:
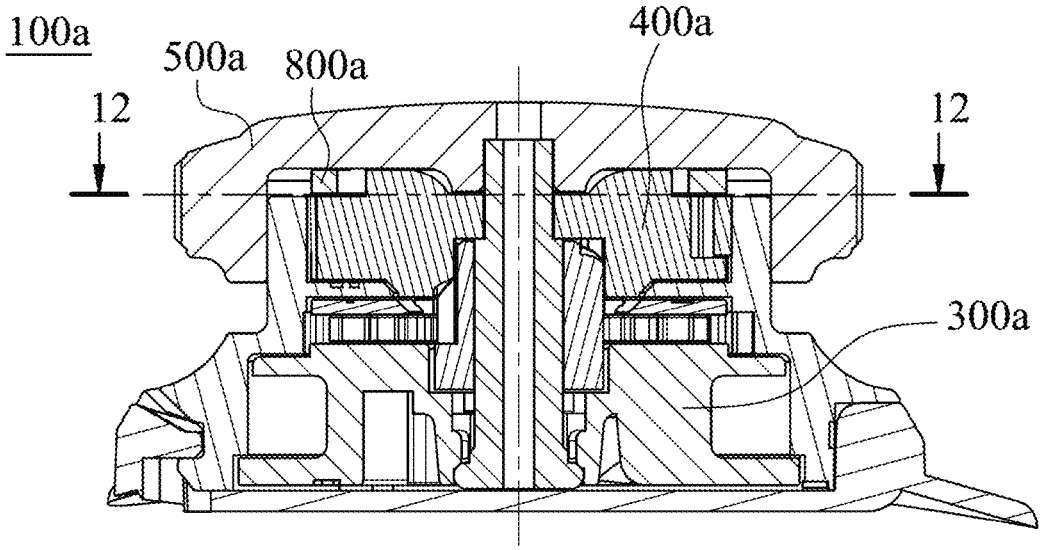
FIG. 10 shows one cross-sectional side view of the fastening device of the second embodiment of FIG. 7.
Figure 11:
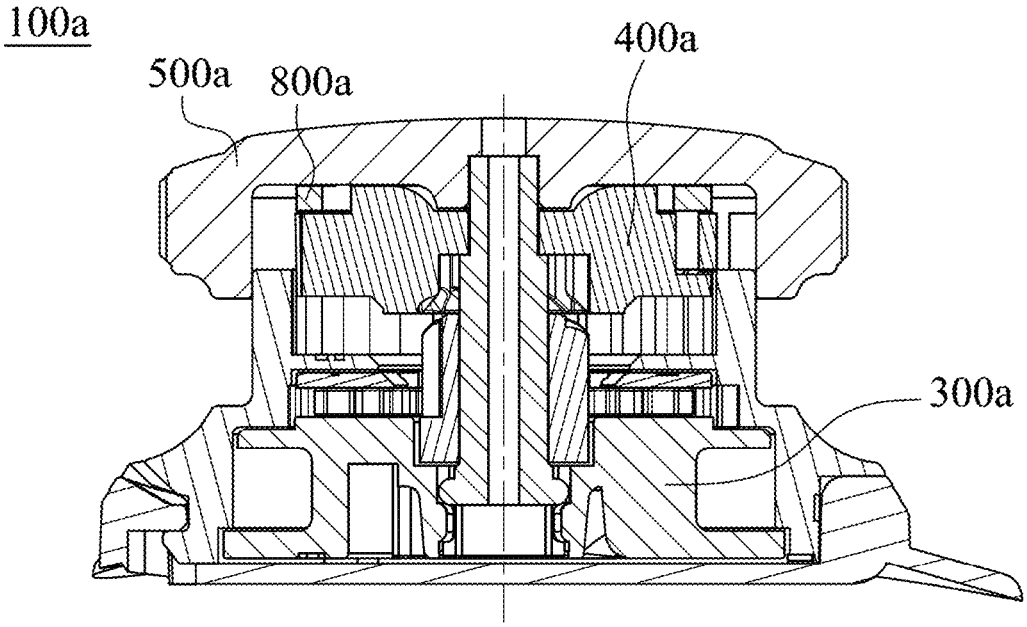
FIG. 11 shows another cross-sectional side view of the fastening device of the second embodiment of FIG. 7.
Figure 12:
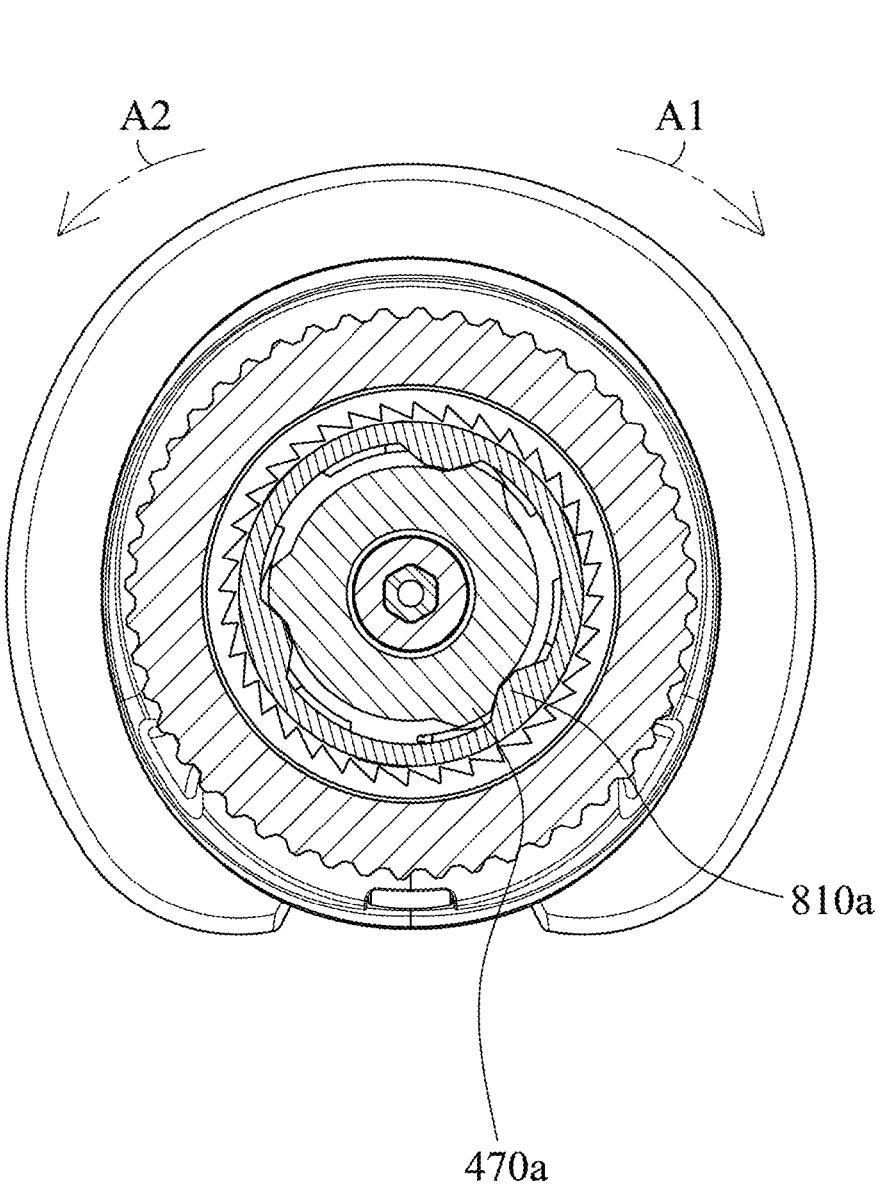
FIG. 12 shows a cross-sectional top view of the fastening device of the second embodiment of FIG. 10 taken along line 12-12.

FIG. 10 shows one cross-sectional side view of the fastening device 100*a* of the second embodiment of FIG. 7. FIG. 11 shows another cross-sectional side view of the fastening device 100*a* of the second embodiment of FIG. 7. FIG. 12 shows a cross-sectional top view of the fastening device 100*a* of the second embodiment of FIG. 10 taken along line 12-12. As shown in FIGS. 10 and 12, the knob 500*a* is not pulled up, and the engaging unit 400*a* is positioned at a first position. As the user holds and rotates the knob 500*a* in the tensioning direction A1, the torque unit 800*a* is rotated to allow each of the torque portions 810*a* to push each of the forced portions 470*a* and to transmit a rotating force of the knob 500*a* to the engaging unit 400*a*, thereby driving the spool 300*a* to rotate in the tensioning direction A1 to tension the lace.

As the lace is tensioned, a force will exert on the spool 300*a* and try to rotate the spool 300*a* in the releasing direction A2, and each of the forced portions 470*a* will try to push each of the torque portions 810*a* toward the releasing direction A2. Consequently, as a force borne by each of the torque portions 810*a* exceeds a threshold, each of the torque portions 810*a* deforms radially and outward. The knob 500*a* and the torque unit 800*a* rotate relative to the engaging unit 400*a*, and the spool 300*a* cannot be driven in the tensioning direction A1 for tensioning the lace. It is noted that, a gap is contained between the torque disc 820*a* and an inner annular surface of the knob 500*a*, and the gap is for the torque disc 820*a* to deform radially and outward. Moreover, as shown in FIG. 11, the knob 500*a* is pulled upward to release the lace, and details thereof will not be repeated.

Figure 13:
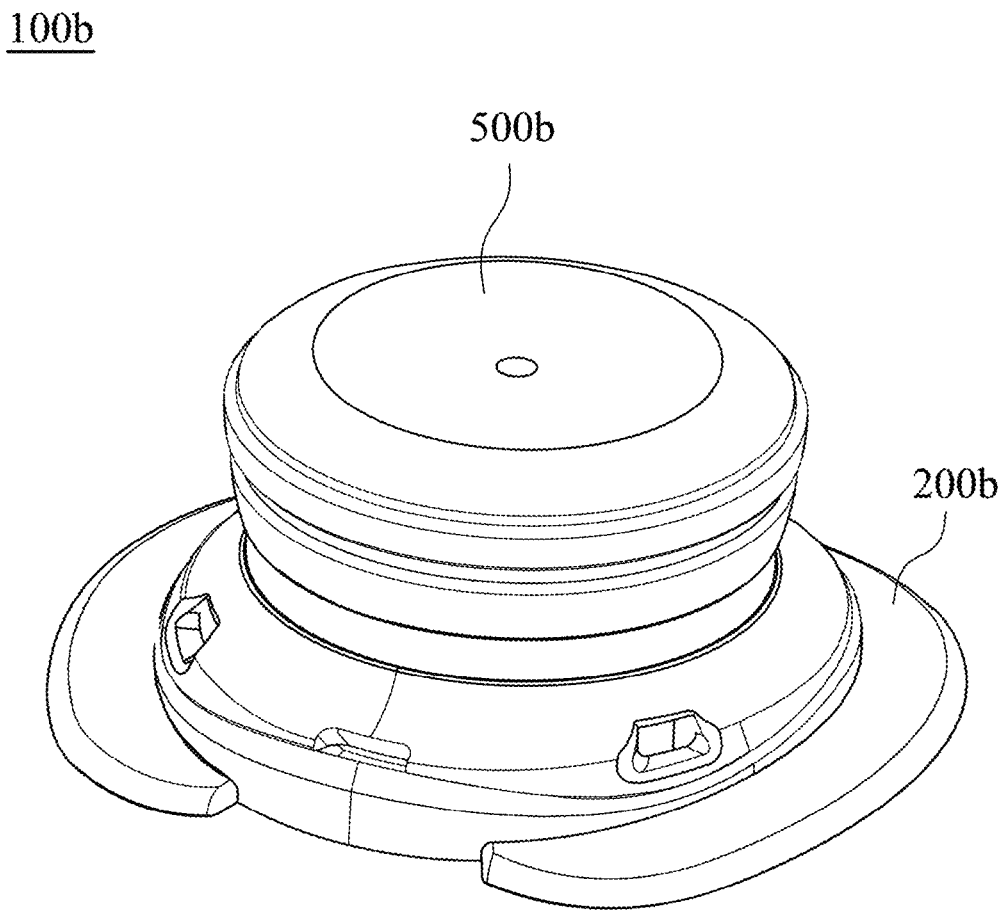
FIG. 13 shows a three-dimensional schematic view of a fastening device according to a third embodiment of the present disclosure.
Figure 14:
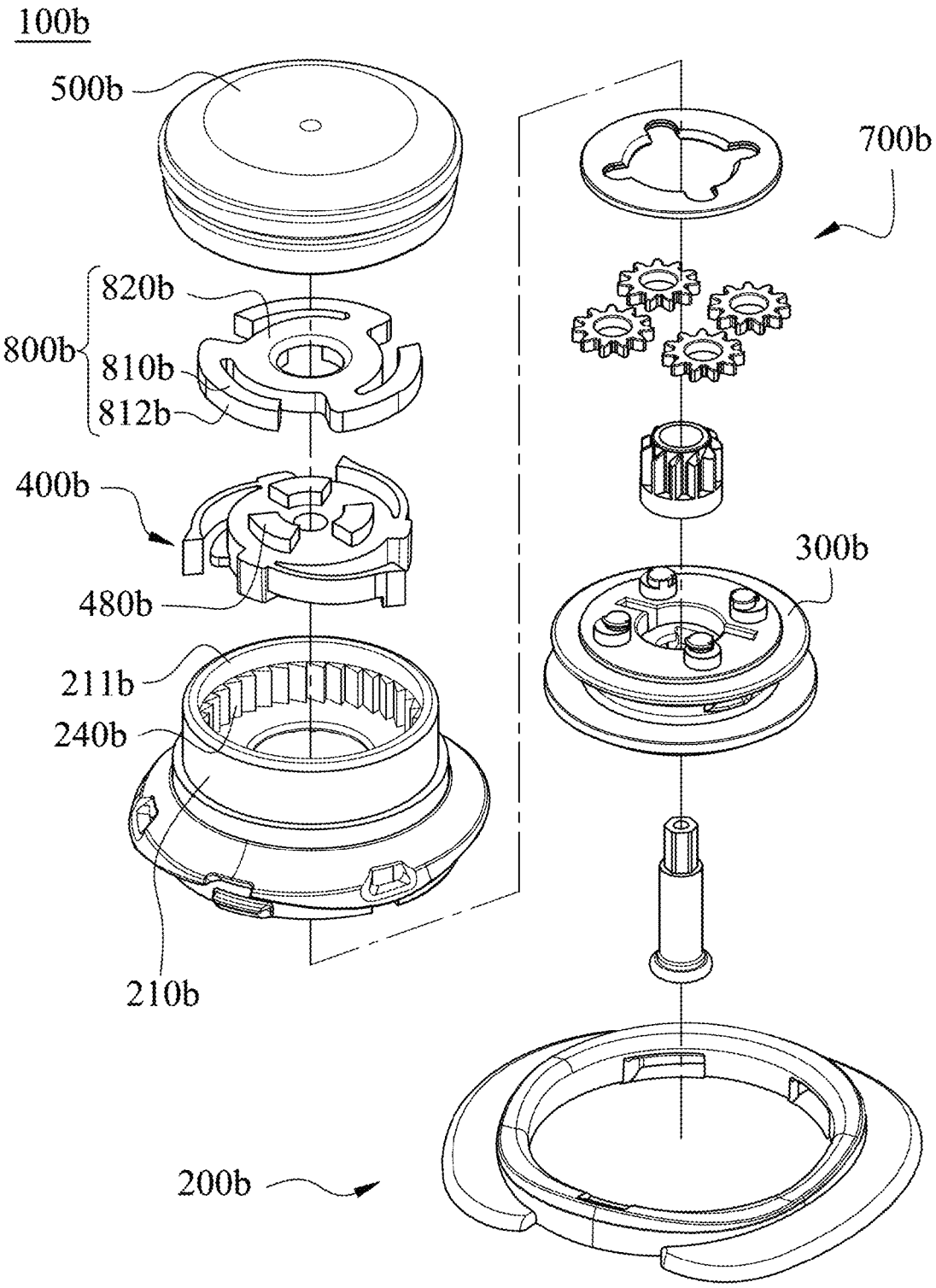
FIG. 14 shows one exploded view of the fastening device of the third embodiment of FIG. 13.
Figure 15:
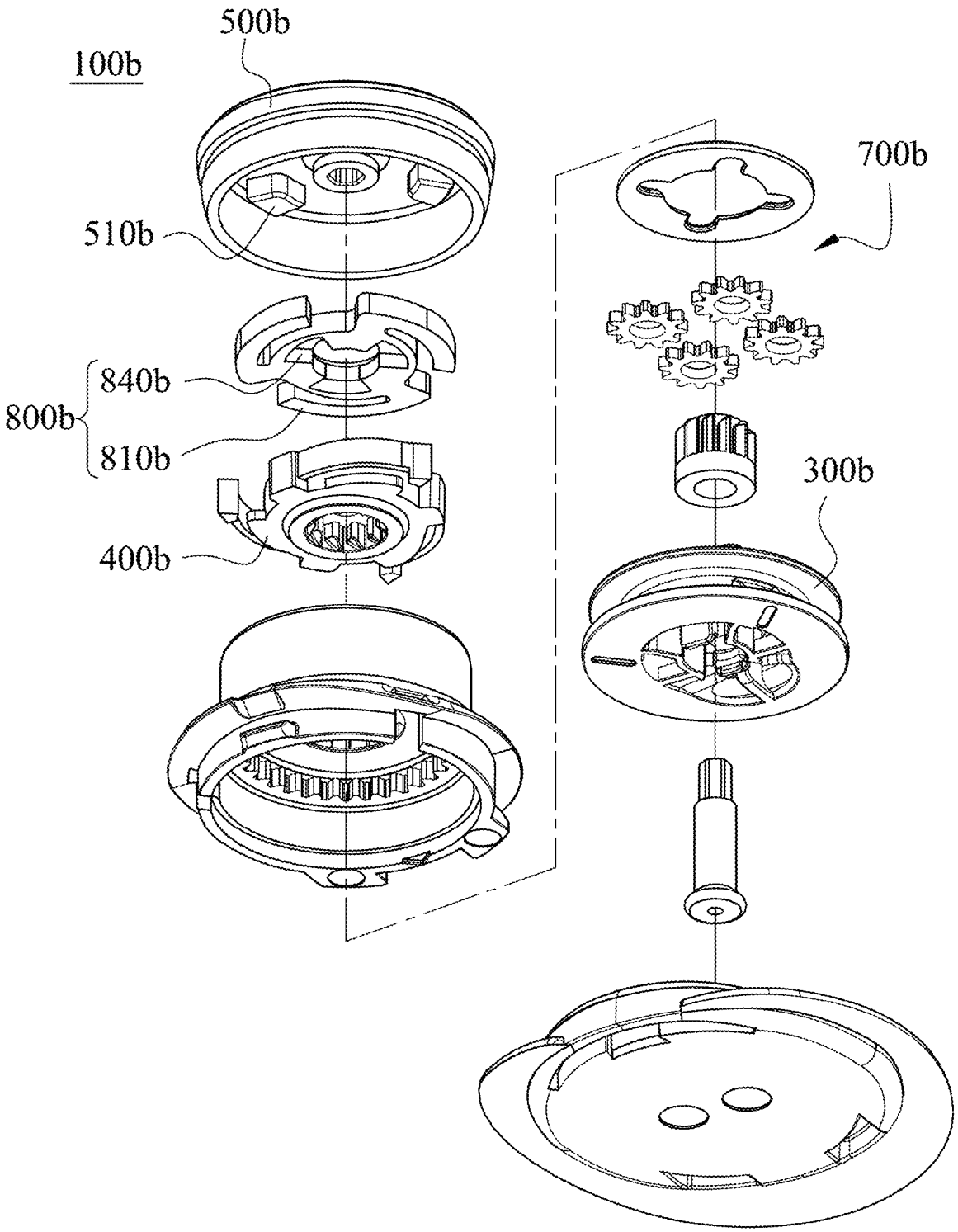
FIG. 15 shows another exploded view of the fastening device of the third embodiment of FIG. 13.

FIG. 13 shows a three-dimensional schematic view of a fastening device 100*b* according to a third embodiment of the present disclosure. FIG. 14 shows one exploded view of the fastening device 100*b* of the third embodiment of FIG. 13. FIG. 15 shows another exploded view of the fastening device 100*b* of the third embodiment of FIG. 13. The structure of the fastening device 100*b* of the third embodiment is similar to the structure of the fastening device 100 of the first embodiment and includes a knob 500*b*, a torque unit 800*b*, an engaging unit 400*b*, a transmission set 700*b*, a spool 300*b* and a case unit 200*b*. Only the differences thereof are illustrated hereinafter, and the identical or similar contents will not be repeated.

The torque unit 800*b* and the engaging unit 400*b* are rotatably connected. The torque unit 800*b* includes a torque disc 820*b* and three torque portions 810*b*, each of the torque portions 810*b* extends along a circumferential direction of the torque unit 800*b*, especially extending along the circumferential direction of the torque disc 820*b*. The knob 500*b* includes three pushing portions 510*b* respectively pushing the distal ends of the three torque portions 810*b* to rotate the spool 300*b* in the tensioning direction A1. As a force borne by each of the torque portions 810*b* exceeds a threshold, a friction force between a friction surface 812*b* of each of the torque portions 810*b* and the case unit 200*b* prohibits the knob 500*b* from rotating the spool 300*b*.

To be more specific, the torque unit 800*b* includes three connecting portions (not labeled), the three connecting portions are disposed at an outer edge of the torque disc 820*b* with intervals, and each of the connecting portions extends radially and outward. Each of the torque portions 810*b* extends integrally along the circumference direction from one side surface of each of the connecting portions, and a distal end of each of the torque portions 810*b* includes an end plane 813*b* (labeled in FIG. 18). Each of the pushing portions 510*b* of the knob 500*b* may include a pushing surface 512*b* (labeled in FIG. 18) abutted against each of the end plane 813*b*, and as the knob 500*b* is rotated in the tensioning direction A1, each of the torque portions 810*b* is pushed so as to allow the torque unit 800*b* to rotate in the tensioning direction A1.

The torque unit 800*b* may further include three engaging grooves 840*b* depressedly disposed at the torque disc 820*b*. The engaging unit 400*b* may include three engaging protrusions 480*b*, and the engaging protrusions 480*b* are respectively engaged with the engaging grooves 840*b*, thereby rotatably connecting the torque unit 800*b* and the engaging unit 400*b*.

The housing 210*b* of the case unit 200*b* may include an upper portion 211*b*. The upper portion 211*b* is located at an upper side of engaging teeth 240*b* and is toothless. After the torque unit 800*b* is assembled in the case unit 200*b*, the friction surface 812*b* of each of the torque portions 810*b* faces toward the upper portion 211*b*.

Figure 16:
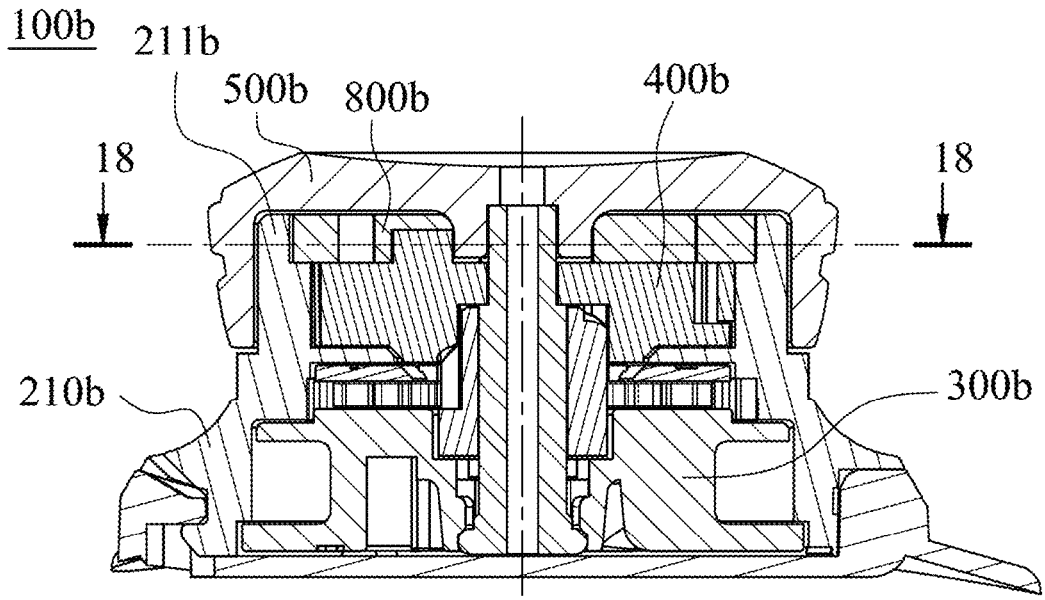
FIG. 16 shows one cross-sectional side view of the fastening device of the third embodiment of FIG. 13.
Figure 17:
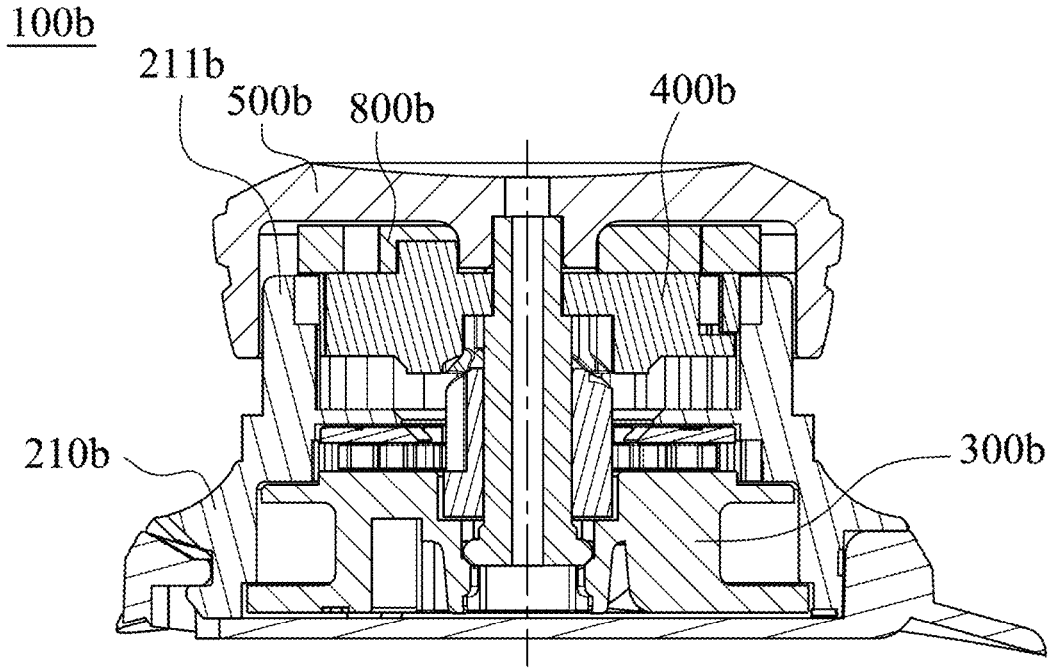
FIG. 17 shows another cross-sectional side view of the fastening device of the third embodiment of FIG. 13.
Figure 18:
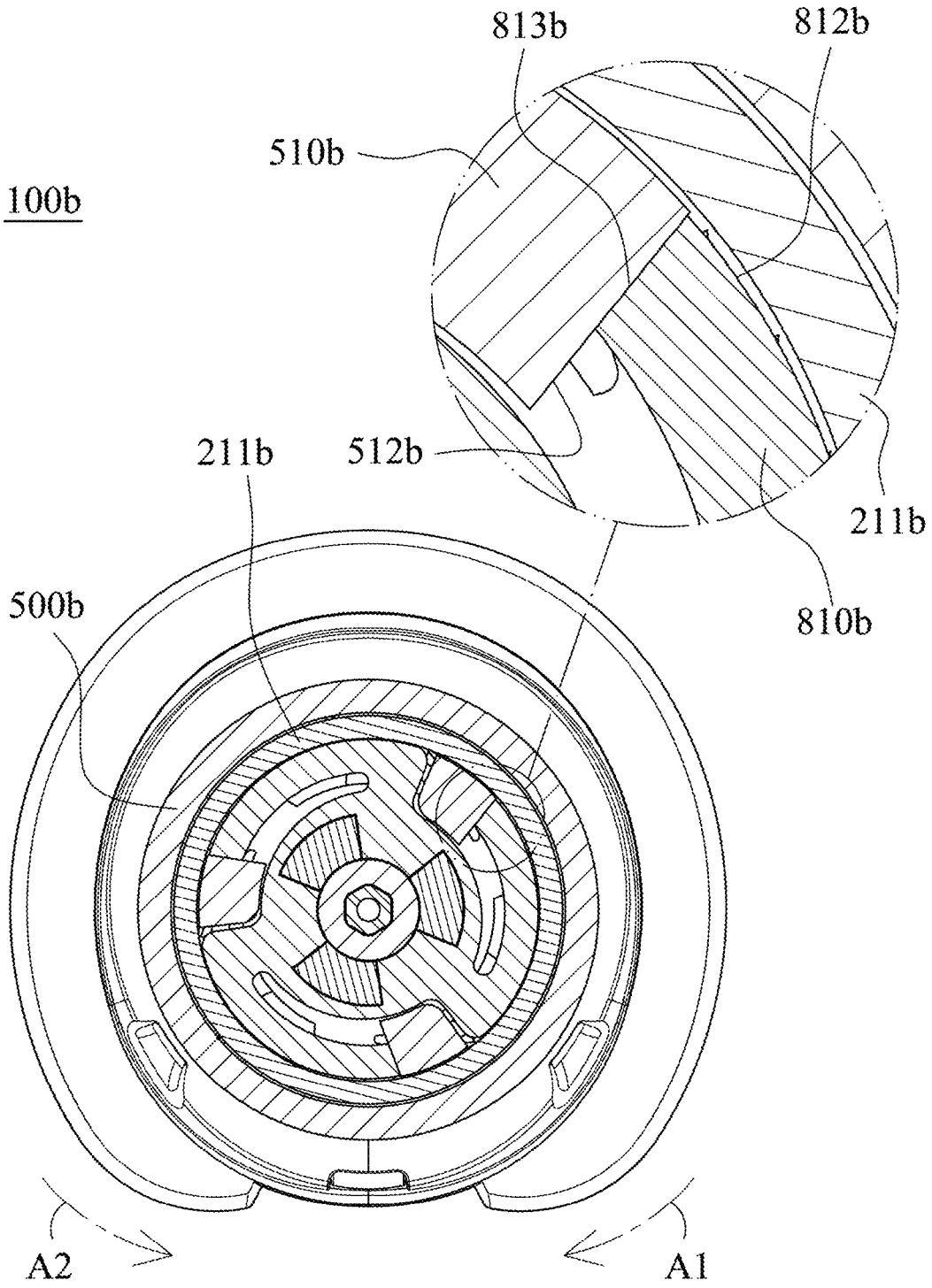
FIG. 18 shows a cross-sectional top view of the fastening device of the third embodiment of FIG. 16 taken along line 18-18.

FIG. 16 shows one cross-sectional side view of the fastening device 100*b* of the third embodiment of FIG. 13. FIG. 17 shows another cross-sectional side view of the fastening device 100*b* of the third embodiment of FIG. 13. FIG. 18 shows a cross-sectional top view of the fastening device 100*b* of the third embodiment of FIG. 16 taken along line 18-18. As shown in FIGS. 16 and 18, the knob 500*b* is not pulled up, and the engaging unit 400*b* is positioned at a first position. As the user holds and rotates the knob 500*b* in the tensioning direction A1, each of the pushing portions 510*b* may push each of the torque portions 810*b* to rotate the torque unit 800*b* for transmitting a rotating force of the knob 500*b* to the engaging unit 400*b*, thereby driving the spool 300*b* to rotate in the tensioning direction A1 to tension the lace.

As the lace is tensioned, a force will exert on the spool 300*b* and try to rotate the spool 300*b* in the releasing direction A2, which causes difficulty in rotating the engaging unit 400*b* in the tensioning direction A1. Therefore, as each of the pushing portions 510*b* pushes each of the torque portions 810*b*, each of the torque portions 810*b* will be bended so as to allow the friction surface 812*b* thereof contacts an inner wall of the upper portion 211*b* of the housing 210*b* to generate the friction force. As a force borne by each of the torque portions 810*b* exceeds a threshold, a bending curve of each of the torque portions 810*b* becomes larger, which may lead to a larger contacting surface between each of the friction surfaces 812*b* and the upper portion 211*b*. As a result, the friction force is increased, the knob 500*b* cannot drive the torque unit 800*b* to rotate in the tensioning direction A1, and the spool 300*b* cannot be driven in the tensioning direction A1 for tensioning the lace. Moreover, as shown in FIG. 17, the knob 500*b* is pulled upward to release the lace, and details thereof will not be repeated.

Figure 19:
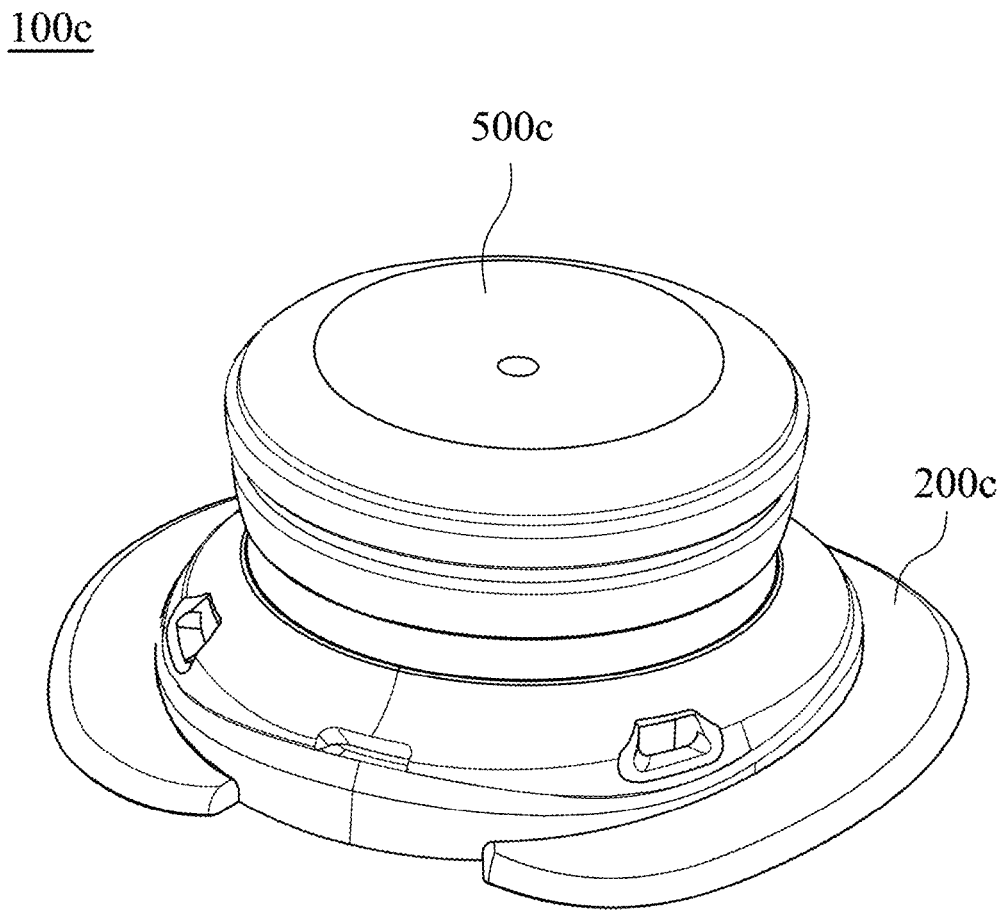
FIG. 19 shows a three-dimensional schematic view of a fastening device according to a fourth embodiment of the present disclosure.
Figure 20:
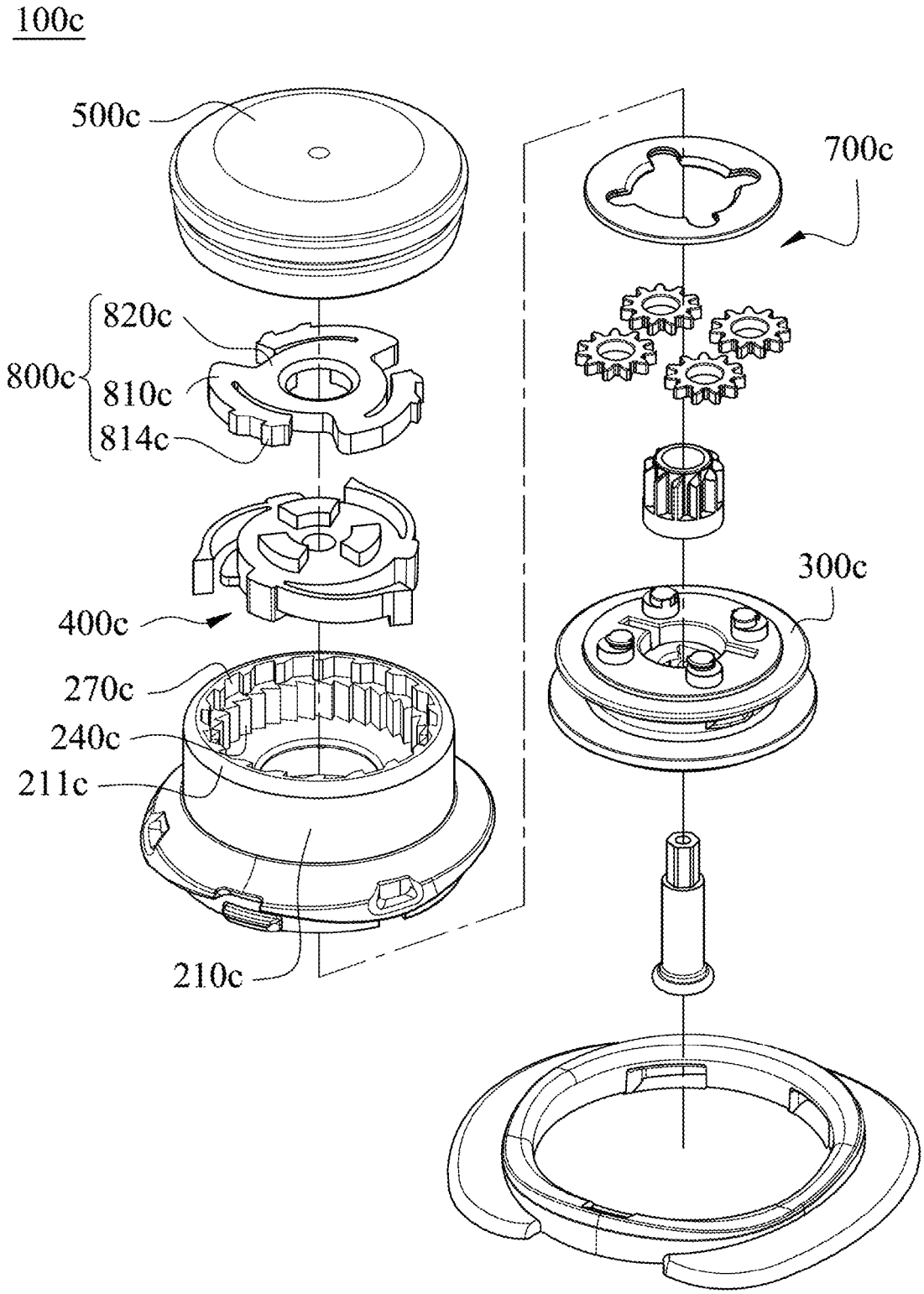
FIG. 20 shows one exploded view of the fastening device of the fourth embodiment of FIG. 19.
Figure 21:
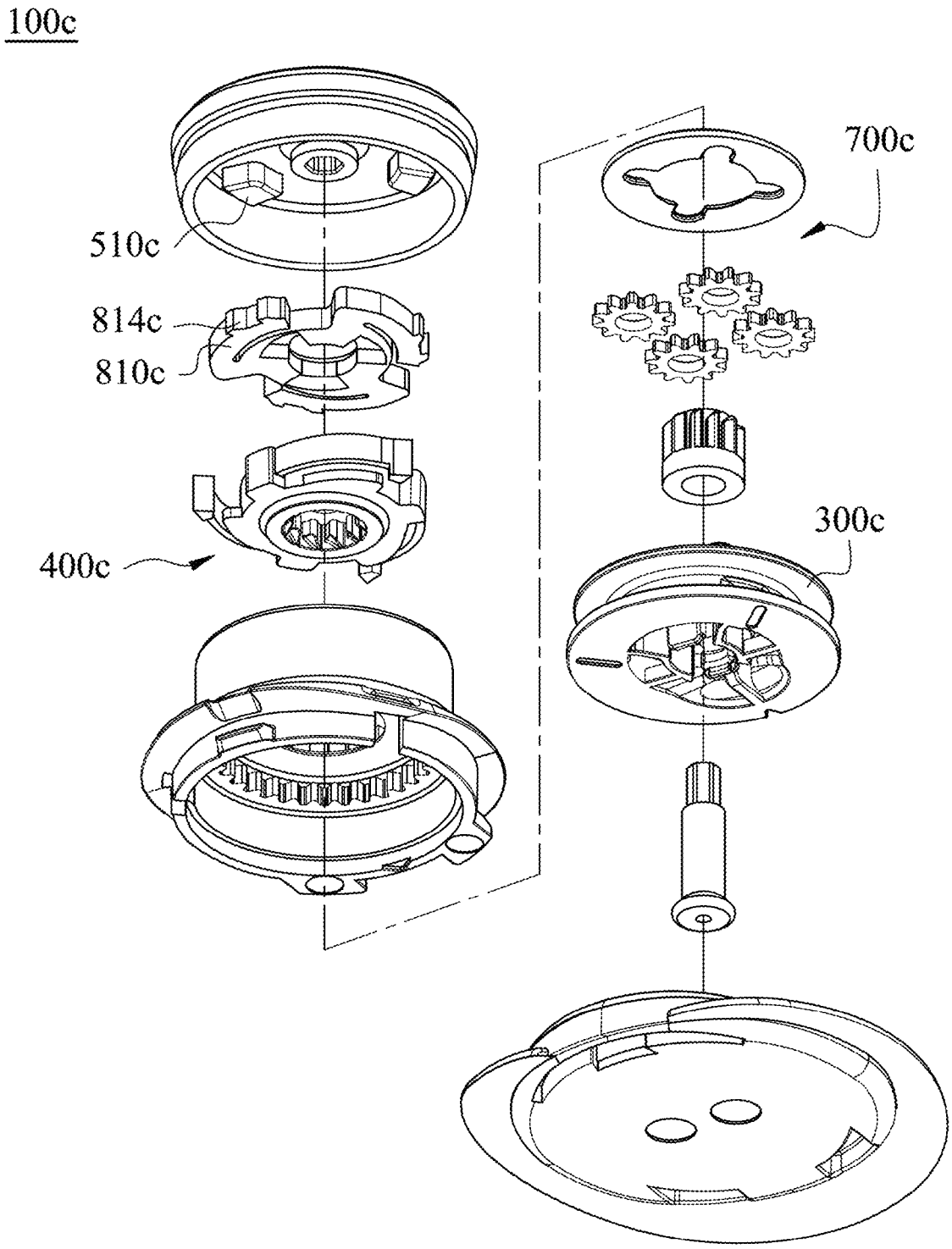
FIG. 21 shows another exploded view of the fastening device of the fourth embodiment of FIG. 19.

FIG. 19 shows a three-dimensional schematic view of a fastening device 100*c* according to a fourth embodiment of the present disclosure. FIG. 20 shows one exploded view of the fastening device 100*c* of the fourth embodiment of FIG. 19. FIG. 21 shows another exploded view of the fastening device 100*c* of the fourth embodiment of FIG. 19. The structure of the fastening device 100*c* of the forth embodiment is similar to the structure of the fastening device 100*b* of the third embodiment and includes a knob 500*c*, a torque unit 800*c*, an engaging unit 400*c*, a transmission set 700*c*, a spool 300*c* and a case unit 200*c*. Only the differences thereof are illustrated hereinafter, and the identical or similar contents will not be repeated.

The torque unit 800*c* and the engaging unit 400*c* are rotatably connected. The torque unit 800*c* includes a torque disc 820*c* and three torque portions 810*c*, and each of the torque portions 810*c* extends along a circumferential direction of the torque unit 800*c*, especially extending along the circumferential direction of the torque disc 820*c*. Each of the torque portions 810*c* may include a torque tooth 814*c*. The knob 500*c* includes three pushing portions 510*c* respectively pushing the three torque portions 810*c* to rotate the spool 300*c* in the tensioning direction A1. The case unit 200*c* may include a plurality of depressions 270*c*. As a force borne by each of the torque portions 810*c* exceeds a threshold, each of the torque portions 810*c* is bended to allow the torque tooth 814*c* thereof to engage with one of the depressions 270*c*, thereby prohibiting the knob 500*c* from rotating the spool 300*c*.

Precisely, the housing 210*c* of the case unit 200*c* may include an upper portion 211*c*. The upper portion 211*c* is located an upper side of engaging teeth 240*c*, and the depressions 270*c* are located at the upper portion 211*c*. The torque tooth 814*c* of each of the torque portions 810*c* may have an external toothed structure and is near a distal end of each of the torque portions 810*c*. After the torque unit 800*c* is assembled in the case unit 200*c*, the torque tooth 814*c* of each of the torque portions 810*c* faces toward the depressions 270*c*.

Figure 22:
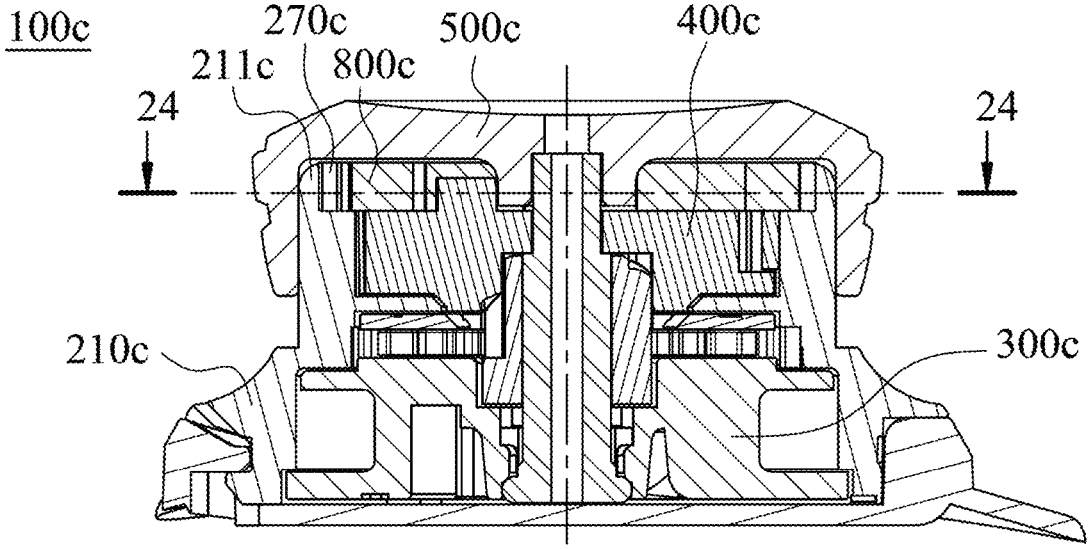
FIG. 22 shows one cross-sectional side view of the fastening device of the fourth embodiment of FIG. 19.
Figure 23:
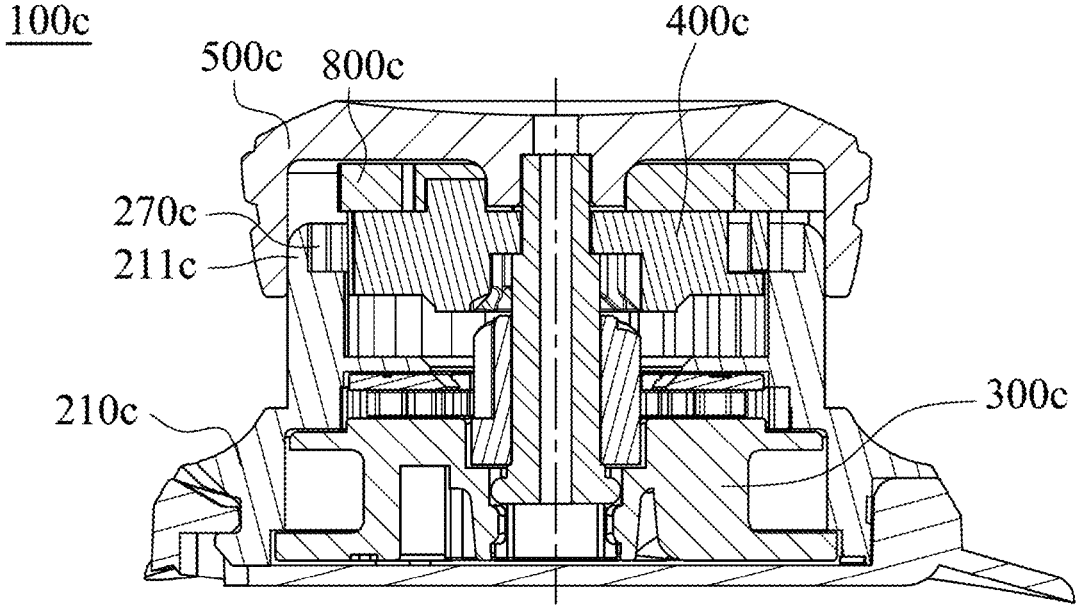
FIG. 23 shows another cross-sectional side view of the fastening device of the fourth embodiment of FIG. 19.
Figure 24:
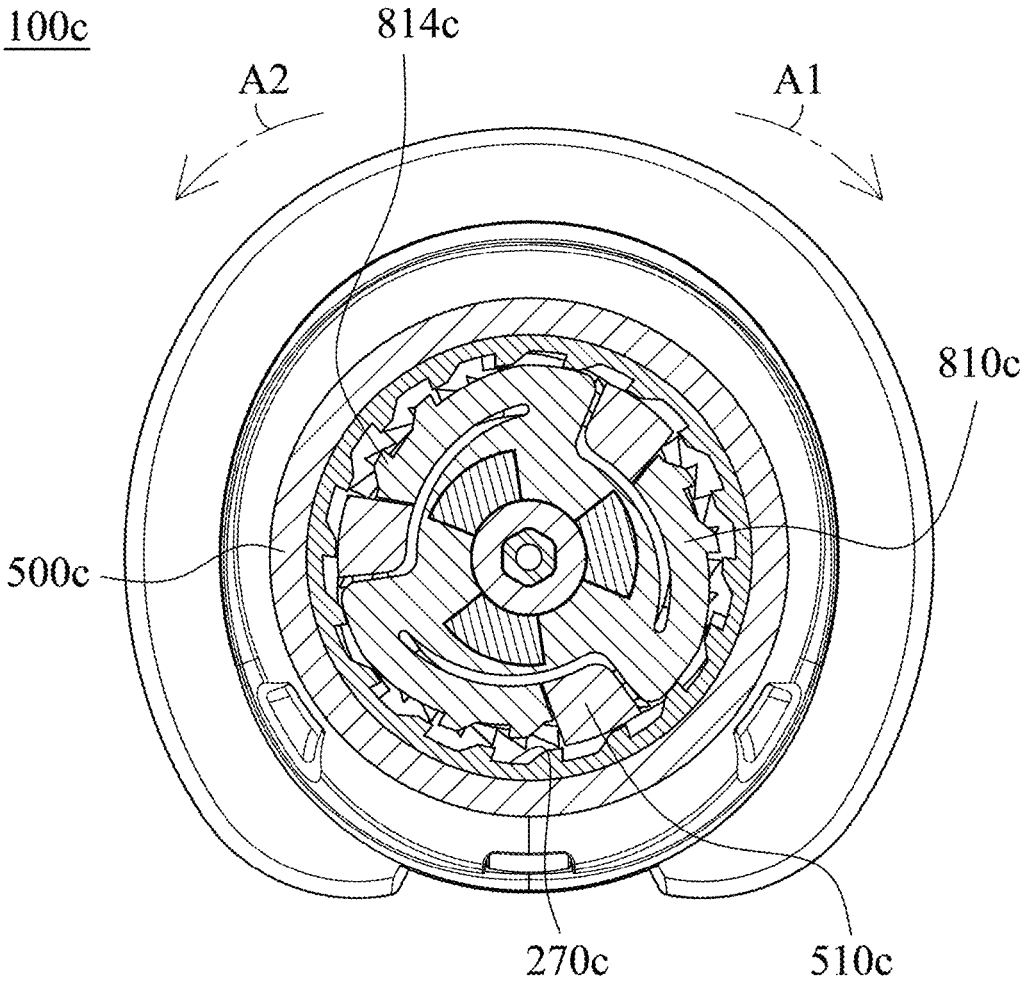
FIG. 24 shows a cross-sectional top view of the fastening device of the fourth embodiment of FIG. 22 taken along line 24-24.

FIG. 22 shows one cross-sectional side view of the fastening device 100*c* of the fourth embodiment of FIG. 19. FIG. 23 shows another cross-sectional side view of the fastening device 100*c* of the fourth embodiment of FIG. 19. FIG. 24 shows a cross-sectional top view of the fastening device 100*c* of the fourth embodiment of FIG. 22 taken along line 24-24. As shown in FIGS. 22 and 24, the knob 500*c* is not pulled up, and the engaging unit 400*c* is positioned at a first position. As the user holds and rotates the knob 500*c* in the tensioning direction A1, each of the pushing portions 510*c* may push each of the torque portions 810*c* to rotate to torque unit 800*c* for transmitting a rotating force of the knob 500*c* to the engaging unit 400*c* owing to that the torque tooth 814*c* of each of the torque portions 810*c* does not engage with the depressions 270*c*, thereby driving the spool 300*c* to rotate in the tensioning direction A1 to tension the lace.

As the lace is tensioned, a force will exert on the spool 300*c* and try to rotate the spool 300*c* in the releasing direction A2, which causes difficulty in rotating the engaging unit 400*c* in the tensioning direction A1. Therefore, as each of the pushing portions 510*c* pushes each of the torque portions 810*c*, each of the torque portions 810*c* will be bended, and the torque tooth 814*c* of each of the torque portions 810*c* starts to engage with the depressions 270*c*. As a force borne by each of the torque portions 810*c* exceeds a threshold, a bending curve of each of the torque portions 810*c* becomes larger, which may lead to a complete engagement between the torque tooth 814*c* of each of the torque portions 810*c* and the depressions 270*c*. As a result, the knob 500*c* cannot drive the torque unit 800*c* to rotate in the tensioning direction A1, and the spool 300*c* cannot be driven in the tensioning direction A1 for tensioning the lace. Moreover, as shown in FIG. 23, the knob 500*c* is pulled upward to release the lace, and details thereof will not be repeated.

Figure 25:
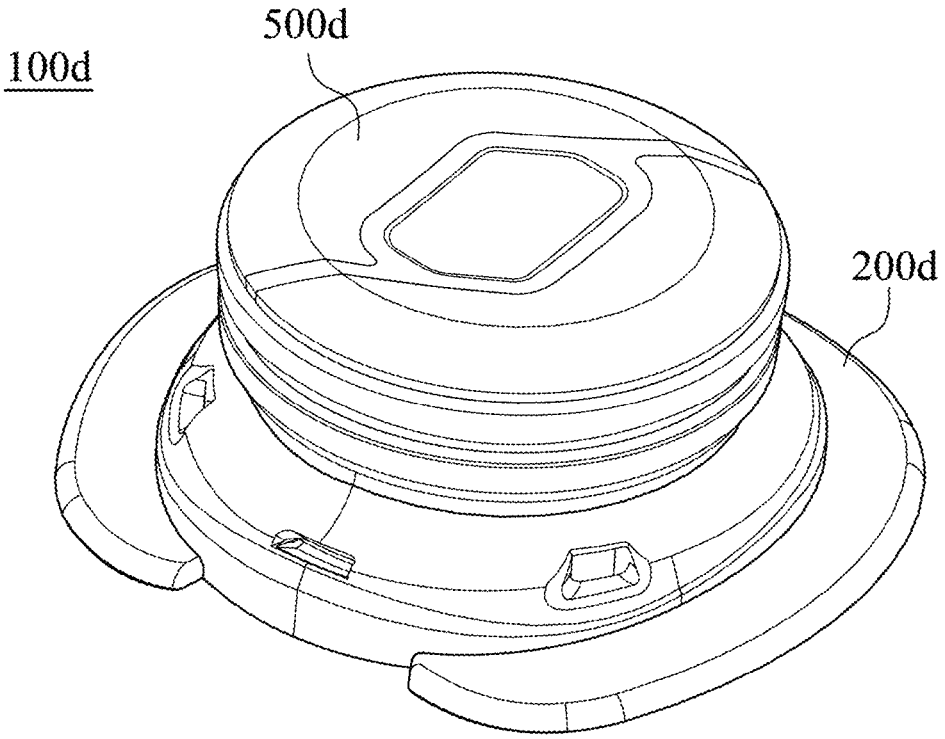
FIG. 25 shows a three-dimensional schematic view of a fastening device according to a fifth embodiment of the present disclosure.
Figure 26:
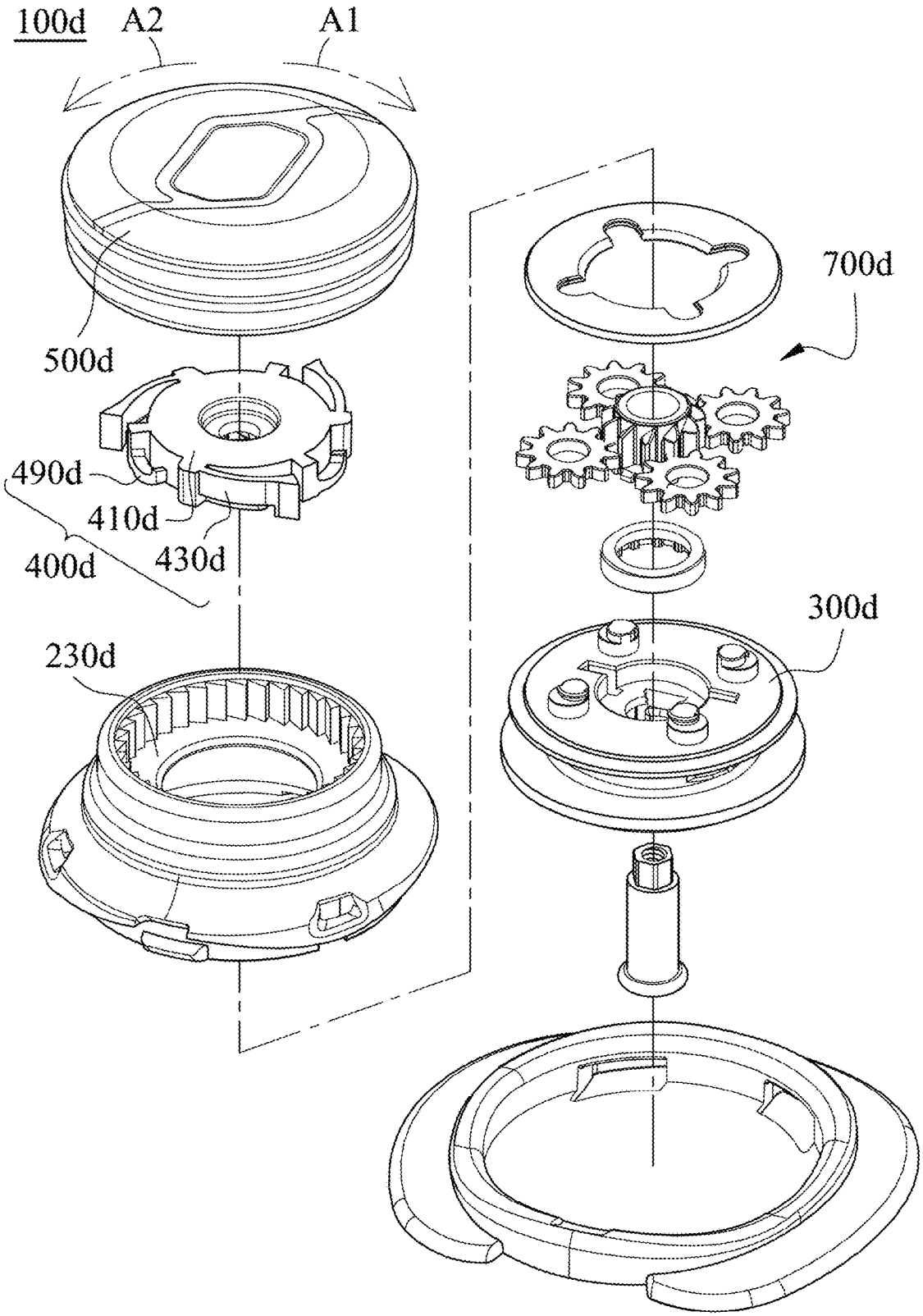
FIG. 26 shows one exploded view of the fastening device of the fifth embodiment of FIG. 25.
Figure 27:
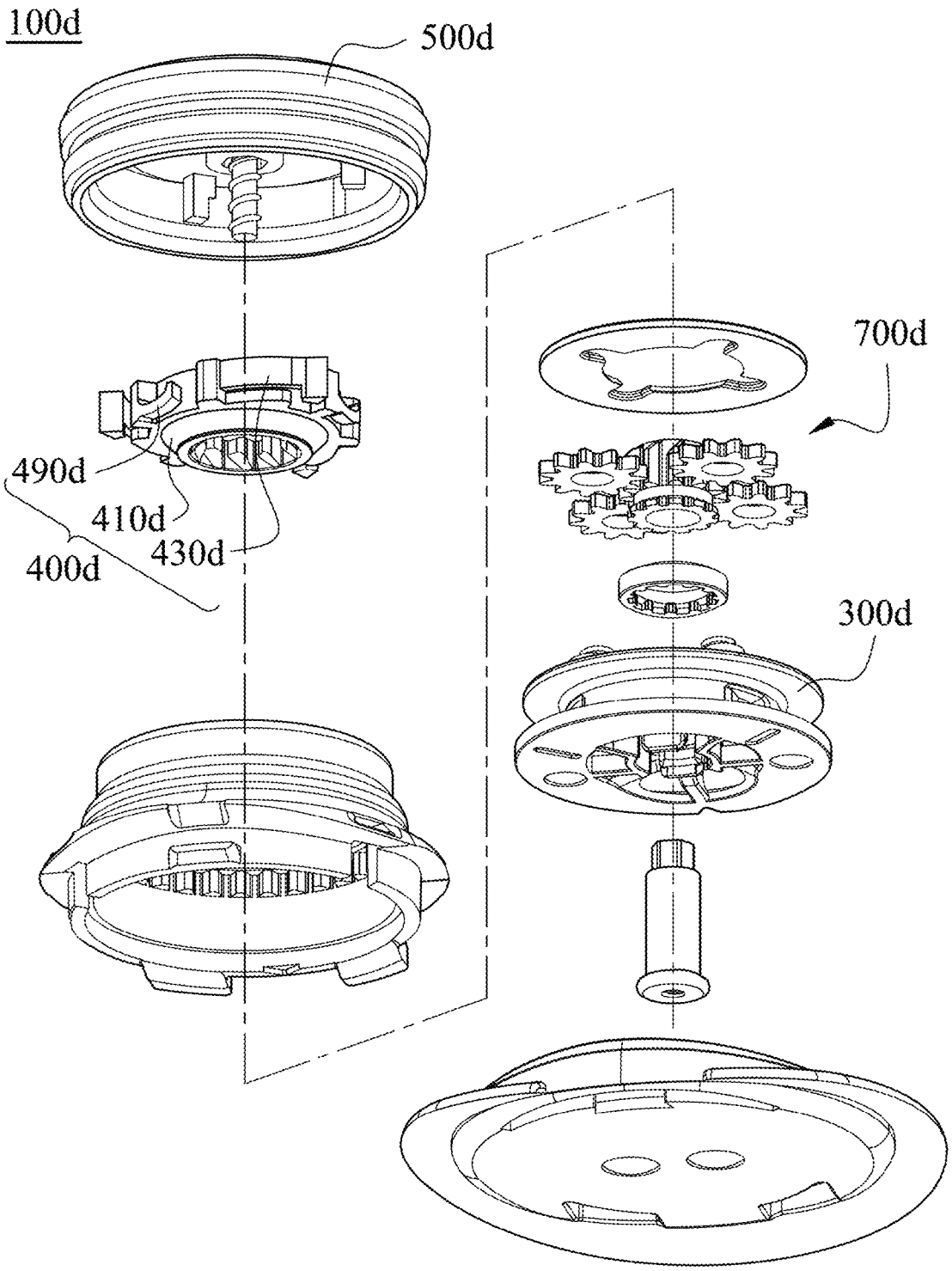
FIG. 27 shows another exploded view of the fastening device of the fifth embodiment of FIG. 25.

FIG. 25 shows a three-dimensional schematic view of a fastening device 100*d* according to a fifth embodiment of the present disclosure. FIG. 26 shows one exploded view of the fastening device 100*d* of the fifth embodiment of FIG. 25. FIG. 27 shows another exploded view of the fastening device 100*d* of the fifth embodiment of FIG. 25. The structure of the fastening device 100*d* of the fifth embodiment is similar to the structure of the fastening device 100*b* of the third embodiment and includes a knob 500*d*, an engaging unit 400*d*, a transmission set 700*d*, a spool 300*d* and a case unit 200*d*, and the engaging unit 400*d* includes at least one pawl arm 430*d*. Only the differences thereof are illustrated hereinafter, and the identical or similar contents will not be repeated.

The fastening device 100*d* may include at least one torque portion 490*d*, and the at least one torque portion 490*d* is rotatably connected to the at least one pawl arm 430*d*. Precisely, a number of the at least one torque portion 490*d* is three, and a number of the at least one pawl arm 430*d* is three. The engaging unit 400*d* may include an engaging disc 410*d*, the three torque portions 490*d* and the three pawl arms 430*d*. The three torque portions 490*d* and the three pawl arms 430*d* are disposed at the engaging disc 410*d* with intervals. In other words, in the fifth embodiment, no independent torque disc is included for placing the torque portions 490*d*, and the torque portions 490*d* are disposed at the engaging disc 410*d*. As the engaging disc 410*d* is located in the upper chamber, each of the torque portions 490*d* may contact a partition 230*d* to generate a friction force.

Figure 28:
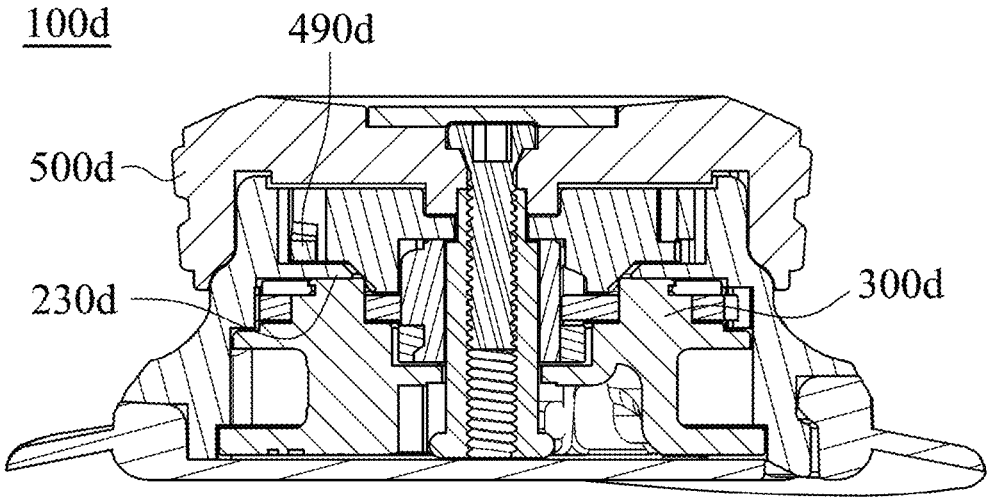
FIG. 28 shows one cross-sectional side view of the fastening device of the fifth embodiment of FIG. 25.
Figure 29:
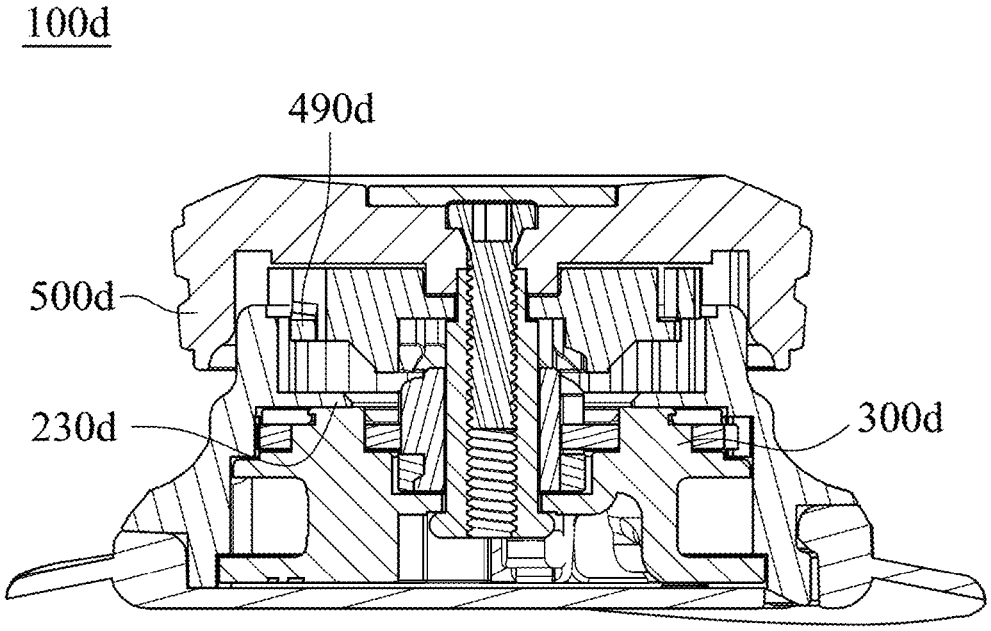
FIG. 29 shows another cross-sectional side view of the fastening device of the fifth embodiment of FIG. 25.

FIG. 28 shows one cross-sectional side view of the fastening device 100*d* of the fifth embodiment of FIG. 25. FIG. 29 shows another cross-sectional side view of the fastening device 100*d* of the fifth embodiment of FIG. 25. As shown in FIG. 28, the knob 500*d* is not pulled up, and the engaging unit 400*d* is positioned at a first position. As the user holds and rotates the knob 500*d* in the tensioning direction A1, in a status that the tension of the lace is small, the friction between each of the torque portions 490*d* and the partition 230*d* does not affect rotation of the spool 300*d* owing to the small friction force therebetween. As a force borne by each of the torque portions 490*d* exceeds a threshold, a bending curve of each of the torque portions 490*d* becomes larger, which may lead to a larger friction force between each of the torque portions 490*d* and the partition 230*d*. As a result, the knob 500*d* cannot drive the engaging unit 400*d* to rotate in the tensioning direction A1, and the spool 300*d* cannot be driven in the tensioning direction A1 for tensioning the lace, thereby preventing over tension of the lace. Moreover, as shown in FIG. 29, the knob 500*d* is pulled upward to release the lace, and details thereof will not be repeated.

Based on the above embodiments, with the configuration of the torque portion, as the lace is over tensioned, the knob may rotate relative to the spool in the tensioning direction, or the knob cannot be rotated in the tensioning direction, and a goal of prohibiting the spool from rotating in the tensioning direction is achieved. Moreover, the torque portion may be disposed at an independent torque disc to form an independent torque unit, or the torque portion may be disposed at the engaging disc while no independent torque unit is included, but the goal that the spool cannot rotate in the tensioning direction while the lace is over tensioned has to be achieved. In addition, a friction force may be generated between the torque portion and any part of the case unit or any part of the knob to prohibit rotation of the knob in the tensioning direction, and the present disclosure is not limited thereto.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the present disclosure. In view of the foregoing, it is intended that the present disclosure cover modifications and variations of this present disclosure provided they fall within the scope of the following claims.

What is claimed is:

1. A fastening device, comprising:

a case unit comprising an inner space;

a spool received within the inner space and configured for a lace to be wound thereabout;

an engaging unit disposed above the spool along an axis;

a torque unit disposed above the engaging unit along the axis and comprising at least one torque portion, wherein the torque unit and the engaging unit are rotatably restricted to each other, and the at least one torque portion extends along a circumferential direction of the torque unit; and a knob covering the case unit and comprising at least one pushing portion pushing a distal end of the at least one torque portion to rotate the spool in a tensioning direction;

wherein as a rotation of the knob in the tensioning direction causes the torque unit to drive the engaging unit for allowing the knob to drive the spool, the spool is rotated in the tensioning direction to tension the lace, and as a force borne by the at least one torque portion exceeds a threshold, a friction force between a friction surface of the at least one torque portion and an inner wall of the case unit prohibits the knob from rotating the spool.

2. The fastening device of claim 1, further comprising a connecting unit, wherein one end of the connecting unit is connected to the knob, and another end of the connecting unit is coupled to the spool.

3. The fastening device of claim 2, wherein the connecting unit comprises a positioning post, and the spool comprises a flexible clamping portion coupled to the positioning post.

4. The fastening device of claim 1, wherein the torque unit and the engaging unit are integrally formed.

* * * * *